US009022016B1

(12) United States Patent
Hafer et al.

(10) Patent No.: US 9,022,016 B1
(45) Date of Patent: May 5, 2015

(54) FOOTBALL THROWING MACHINE

(75) Inventors: Frederick D. Hafer, Wyomissing, PA (US); Matthew E. Wagner, Kutztown, PA (US); Steven R. Wentz, Blandon, PA (US); Donald B. Jackson, Allentown, PA (US)

(73) Assignee: Omnitech Automation, Inc., Emmaus, PA (US)

( * ) Notice: Subject to any disclaimer, the term of this patent is extended or adjusted under 35 U.S.C. 154(b) by 568 days.

(21) Appl. No.: 13/354,704

(22) Filed: Jan. 20, 2012

(51) Int. Cl.
*A63B 69/40* (2006.01)
*F41B 4/00* (2006.01)
*A63B 47/00* (2006.01)

(52) U.S. Cl.
CPC ..... *A63B 69/406* (2013.01); *A63B 47/002* (2013.01); *F41B 4/00* (2013.01); *A63B 2069/402* (2013.01); *A63B 2243/0025* (2013.01)

(58) Field of Classification Search
CPC ..... A63B 69/406; A63B 47/002; A63B 2243/007; A63B 2069/401; A63B 2243/0025; A63B 69/40
USPC ..... 124/6, 78, 82; 473/422, 438, 451
See application file for complete search history.

(56) References Cited

U.S. PATENT DOCUMENTS

| | | | | |
|---|---|---|---|---|
| 1,204,468 | A | | 11/1916 | Marty |
| 1,211,738 | A | | 1/1917 | Marty |
| 2,310,746 | A | | 2/1943 | Parker |
| 2,918,915 | A | | 12/1959 | Doeg |
| 3,774,584 | A | | 11/1973 | Paulson |
| 3,811,421 | A | | 5/1974 | Betten |
| 3,815,567 | A | | 6/1974 | Serra |
| 3,926,170 | A | | 12/1975 | Dixon |
| 3,951,125 | A | | 4/1976 | Dixon |
| 3,977,386 | A | | 8/1976 | Meyer |
| 4,015,578 | A | | 4/1977 | Wright |
| 4,026,261 | A | * | 5/1977 | Paulson et al. ..... 124/78 |
| 4,261,319 | A | | 4/1981 | Dixon |
| 4,291,663 | A | | 9/1981 | Buck |
| 4,460,173 | A | | 7/1984 | Dumas |
| 4,511,141 | A | * | 4/1985 | Dumas ..... 473/419 |
| 4,583,514 | A | | 4/1986 | Nozato |
| 4,596,230 | A | * | 6/1986 | Griffith ..... 124/78 |
| 4,664,094 | A | | 5/1987 | Hurlimann |
| 4,714,248 | A | * | 12/1987 | Koss ..... 473/436 |
| 4,723,532 | A | * | 2/1988 | Osojnak ..... 124/78 |
| 4,834,060 | A | * | 5/1989 | Greene ..... 124/78 |
| 5,044,350 | A | * | 9/1991 | Iwabuchi et al. ..... 124/51.1 |
| 5,107,820 | A | * | 4/1992 | Salansky ..... 124/78 |

(Continued)

*Primary Examiner* — Melba Bumgarner
*Assistant Examiner* — Alexander Niconovich
(74) *Attorney, Agent, or Firm* — RatnerPrestia

(57) ABSTRACT

A football passing machine is configured to eject a prolate-spheroid-shaped football. The football passing machine includes a frame member, an adjustable launch surface mounted to the frame member, a ball magazine positioned above the adjustable launch surface that is configured to contain a plurality of footballs, a moveable escapement arm that is configured to successively dispense footballs that are contained within the ball magazine onto the launch surface, a moveable ball carriage configured to move a football between a first point on the launch surface that is located directly beneath the ball magazine and a second point on the launch surface that is adjacent a football launch mechanism that is configured to eject a football from the football passing machine. An orientation of the adjustable launch surface is configured to be adjusted to change a launch angle of a football while the frame member and the ball magazine remain stationary.

23 Claims, 18 Drawing Sheets

(56) References Cited

U.S. PATENT DOCUMENTS

| | | | | |
|---|---|---|---|---|
| 5,125,653 | A * | 6/1992 | Kovacs et al. | 124/78 |
| 5,127,390 | A | 7/1992 | Paulson | |
| 5,224,701 | A | 7/1993 | Sciarrillo | |
| 5,396,876 | A * | 3/1995 | Liscio et al. | 124/6 |
| 5,417,196 | A * | 5/1995 | Morrison et al. | 124/6 |
| 5,447,144 | A | 9/1995 | Ivy | |
| 5,464,208 | A * | 11/1995 | Pierce | 473/451 |
| 5,465,978 | A * | 11/1995 | Magnone et al. | 124/7 |
| 5,490,493 | A * | 2/1996 | Salansky | 124/78 |
| 5,776,018 | A * | 7/1998 | Simpson et al. | 473/433 |
| 5,979,426 | A * | 11/1999 | Troklus et al. | 124/78 |
| 6,053,821 | A | 4/2000 | Palmer | |
| 6,082,350 | A * | 7/2000 | Crews et al. | 124/78 |
| 6,089,217 | A | 7/2000 | Paulson | |
| 6,200,236 | B1 | 3/2001 | Minami | |
| 6,406,386 | B1 | 6/2002 | Brazzell | |
| 6,440,013 | B1 * | 8/2002 | Brown | 473/422 |
| 6,443,140 | B1 * | 9/2002 | Crews et al. | 124/78 |
| 6,443,859 | B1 * | 9/2002 | Markin | 473/451 |
| 6,523,535 | B2 | 2/2003 | Rehkemper | |
| 6,539,931 | B2 * | 4/2003 | Trajkovic et al. | 124/34 |
| 6,575,852 | B2 | 6/2003 | Orner | |
| 6,637,422 | B2 * | 10/2003 | Wojtkiewicz et al. | 124/78 |
| 6,679,239 | B1 | 1/2004 | Shultz | |
| 6,718,961 | B1 * | 4/2004 | Woods et al. | 124/7 |
| 6,877,499 | B1 | 4/2005 | Otto | |
| 6,877,501 | B2 * | 4/2005 | Wojtkiewicz et al. | 124/78 |
| 6,880,542 | B1 * | 4/2005 | Johndreau et al. | 124/78 |
| 7,040,309 | B2 * | 5/2006 | Johndreau et al. | 124/80 |
| 7,063,082 | B2 | 6/2006 | Vanek | |
| 7,111,620 | B2 * | 9/2006 | Johndreau et al. | 124/51.1 |
| 7,125,349 | B2 | 10/2006 | Tucker | |
| 7,231,913 | B2 * | 6/2007 | Wilson | 124/78 |
| 7,350,515 | B2 | 4/2008 | Yao | |
| 7,445,003 | B2 * | 11/2008 | Smith | 124/78 |
| 7,549,415 | B2 * | 6/2009 | Karellas | 124/16 |
| 7,553,244 | B2 * | 6/2009 | York | 473/438 |
| 7,610,909 | B2 * | 11/2009 | Greene, Jr. | 124/78 |
| 7,691,012 | B2 * | 4/2010 | Cucjen et al. | 473/422 |
| 7,708,003 | B1 * | 5/2010 | Gavieres | 124/78 |
| 7,766,770 | B2 * | 8/2010 | Cucjen et al. | 473/422 |
| 7,823,574 | B2 * | 11/2010 | Chu | 124/78 |
| 7,882,831 | B2 * | 2/2011 | Alger | 124/78 |
| 7,980,967 | B2 * | 7/2011 | Cucjen et al. | 473/422 |
| 8,123,634 | B1 * | 2/2012 | Lovett | 473/433 |
| 8,287,404 | B2 * | 10/2012 | Cucjen et al. | 473/422 |
| 8,932,156 | B2 * | 1/2015 | Boehner | 473/438 |
| 2002/0134367 | A1 | 9/2002 | Delso | |
| 2009/0260612 | A1 | 10/2009 | Grant | |
| 2012/0097145 | A1 * | 4/2012 | Lu | 124/78 |
| 2013/0104869 | A1 * | 5/2013 | Lewis et al. | 124/78 |

* cited by examiner

FOOTBALL THROWING MACHINE

FIELD OF THE INVENTION

The invention is generally directed to a machine for throwing footballs.

BACKGROUND OF THE INVENTION

The invention is generally directed to a machine for throwing footballs. Machines for throwing balls (including footballs) are disclosed in U.S. Pat. Nos. 4,026,261; 6,089,217; 7,553,244; 7,708,003; 5,447,144; and 6,877,501, for example, which are each incorporated by reference in their entirety. Although football throwing machines exist, improvements to existing football throwing machines are continuously sought in the interests of expanding their functionality, reducing their cost and enhancing their manufacturability.

SUMMARY OF THE INVENTION

According to one aspect of the invention, a football passing machine is configured to eject a prolate-spheroid-shaped football. The football passing machine generally includes a frame member, an adjustable launch surface mounted to the frame member, a ball magazine that is configured to contain a plurality of footballs and is positioned above the adjustable launch surface, a moveable escapement arm that is configured to successively dispense footballs that are contained within the ball magazine onto the launch surface, a moveable ball carriage configured to move a football between a first point on the launch surface that is directly beneath the ball magazine and a second point on the launch surface that is adjacent a football launch mechanism that is configured to eject a football from the football passing machine. An orientation of the adjustable launch surface is configured to be adjusted to change a launch angle of a football while the frame member and the ball magazine remain stationary.

According to another aspect of the invention, the moveable ball carriage includes a substantially conical surface that is configured to accommodate an end of a prolate-spheroid-shaped football.

According to yet another aspect of the invention, the football launch mechanism is a friction wheel drive system. The friction wheel drive system includes two rotatable launch wheels that are configured to directly contact the football, wherein each launch wheel is driven by a rotating drive wheel that is positioned against a revolved surface of a respective launch wheel.

BRIEF DESCRIPTION OF THE DRAWING FIGURES

The invention is best understood from the following detailed description when read in connection with the accompanying drawing. It is emphasized that, according to common practice, the various features of the drawing are shown schematically and may not be to scale. Included in the drawing are the following figures:

FIGS. 1-16B depict a first exemplary embodiment of a football passing machine and components thereof, while FIGS. 17-22 depict a second exemplary embodiment of a football passing machine and components thereof.

More particularly, FIGS. 1 and 2 depict perspective views taken from the front and right sides and the rear and right sides, respectively, of a football passing machine (referred to hereinafter as the machine), according to a first exemplary embodiment of the invention.

Figure 2:
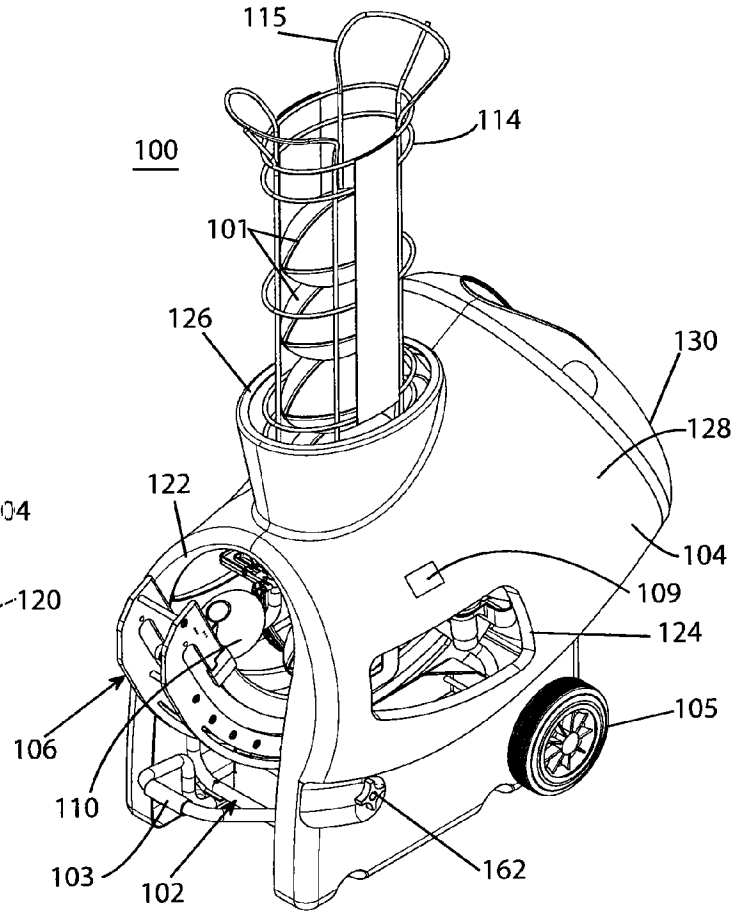
Figure 1:
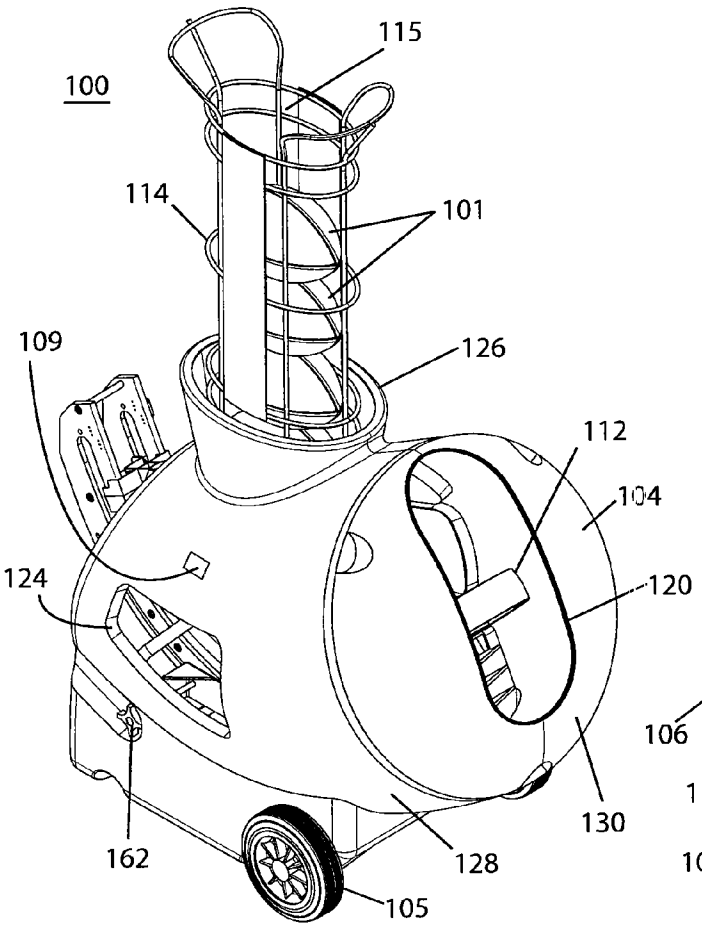
Figure 3:
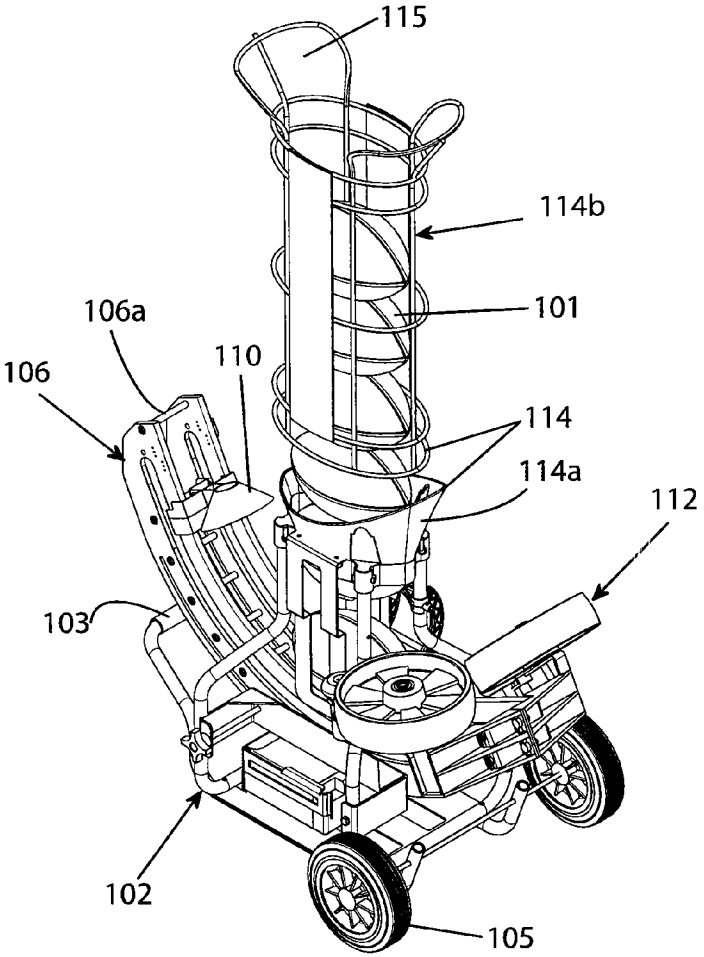
FIGS. 3-6 depict perspective views taken from the front and right sides, the rear and right sides, the rear and left sides, and the front and left sides, respectively, of the machine of FIGS. 1 and 2, with the outer casing removed to reveal internal components of the machine.
Figure 12C:
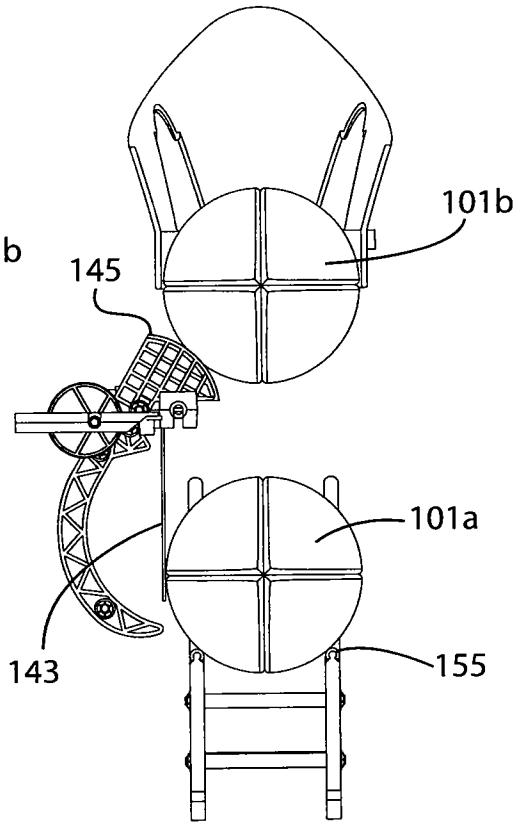
Figure 12B:
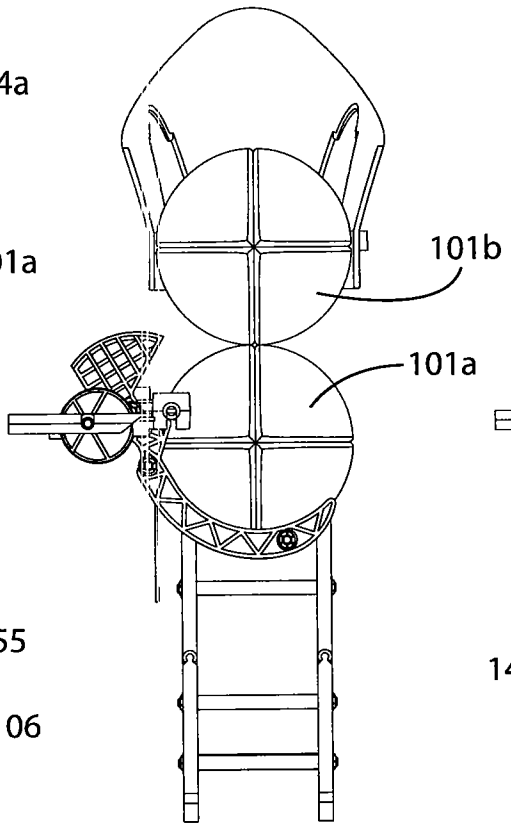
Figure 12A:
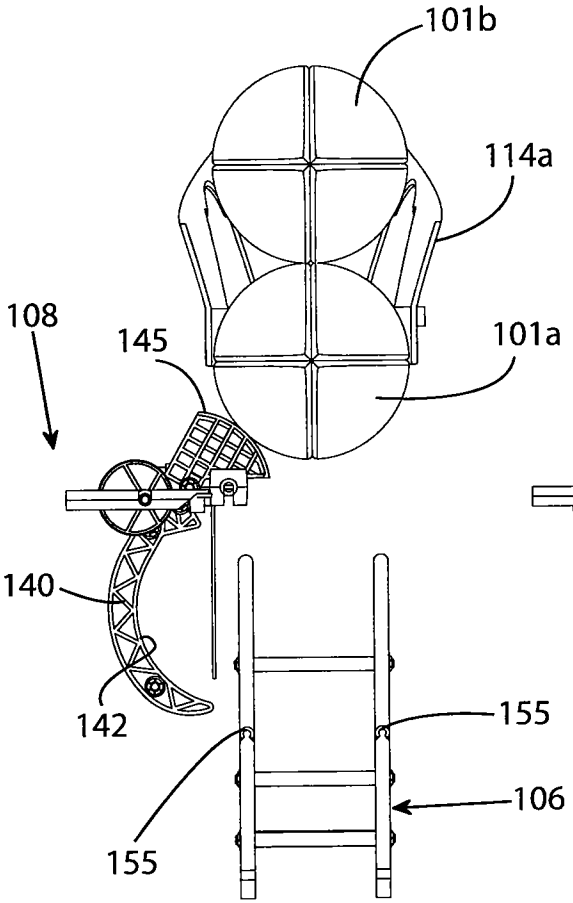

FIGS. 12A-C depict the escapement arm assembly releasing a football onto the ball guidance rail assembly of the machine of FIGS. 1 and 2.

Figure 13:
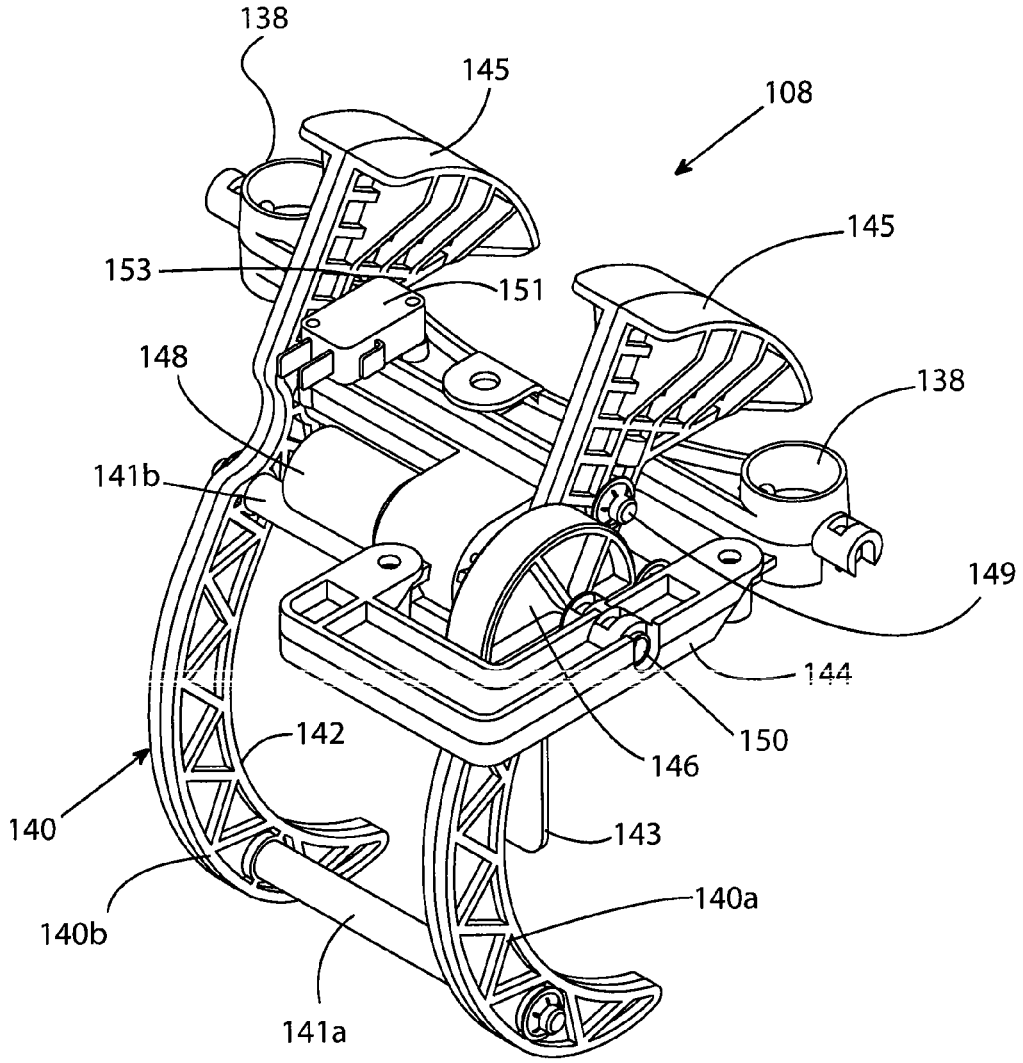
Figure 14:
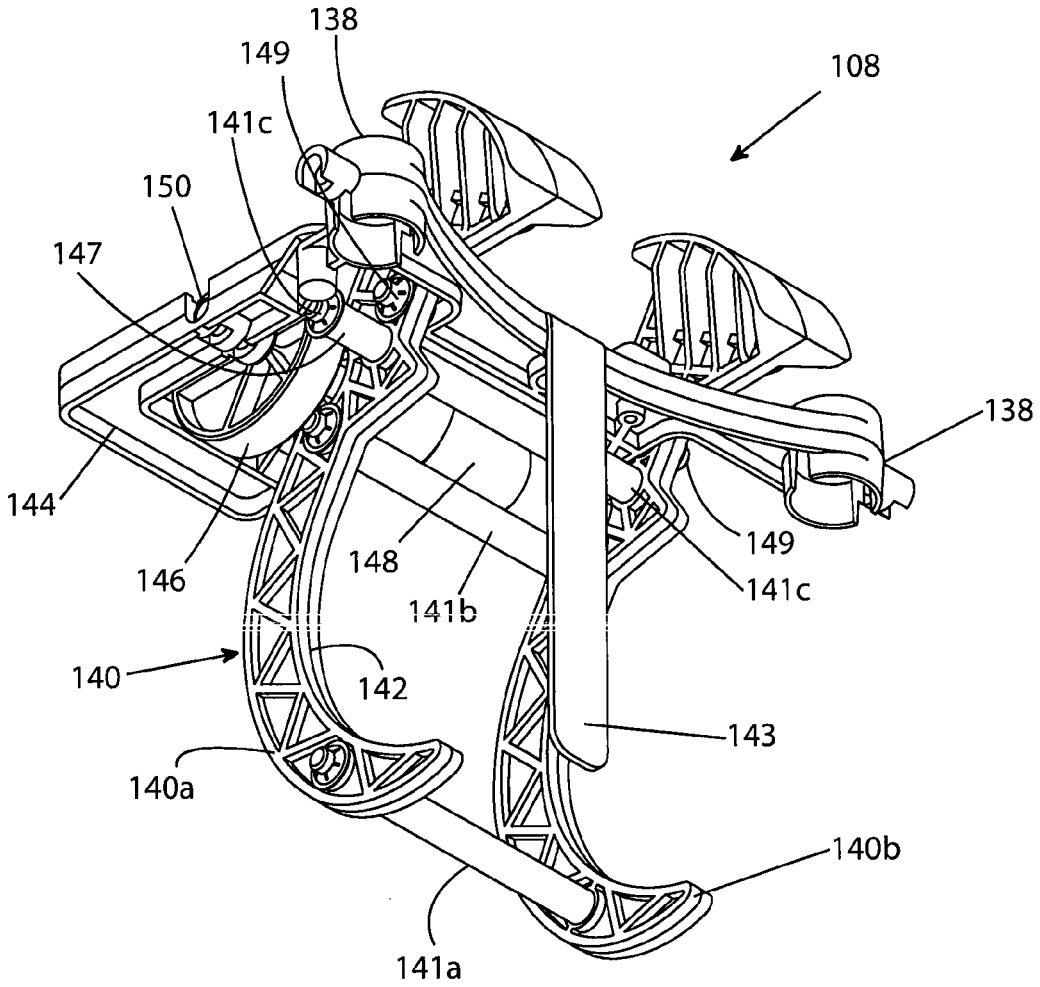

FIGS. 13 and 14 depict perspective views, respectively, of the escapement arm assembly of the machine of FIGS. 1 and 2.

Figure 15A:
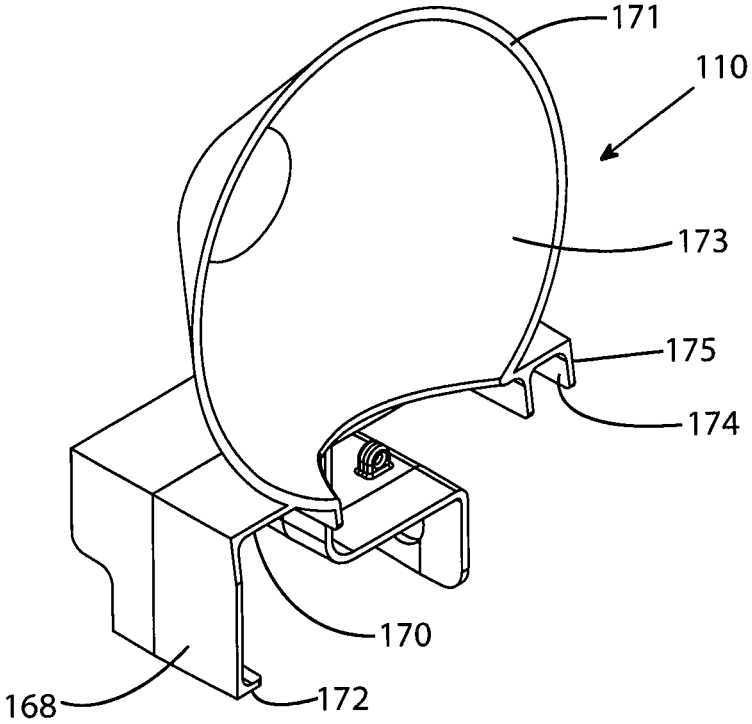
Figure 15B:
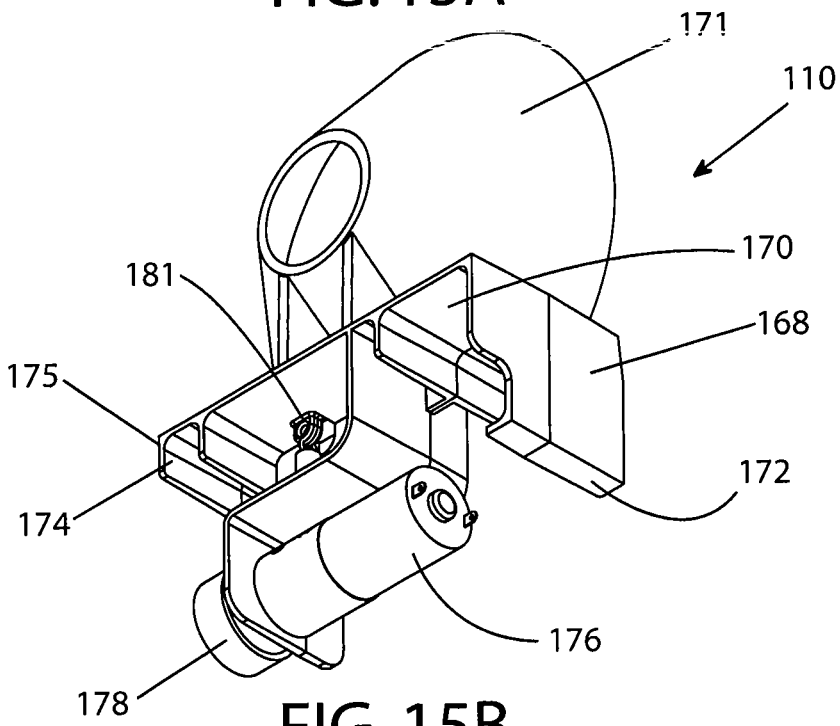

FIGS. 15A and 15B depict perspective views, respectively, of the reciprocating ball carriage assembly of the machine of FIGS. 1 and 2.

Figure 16A:
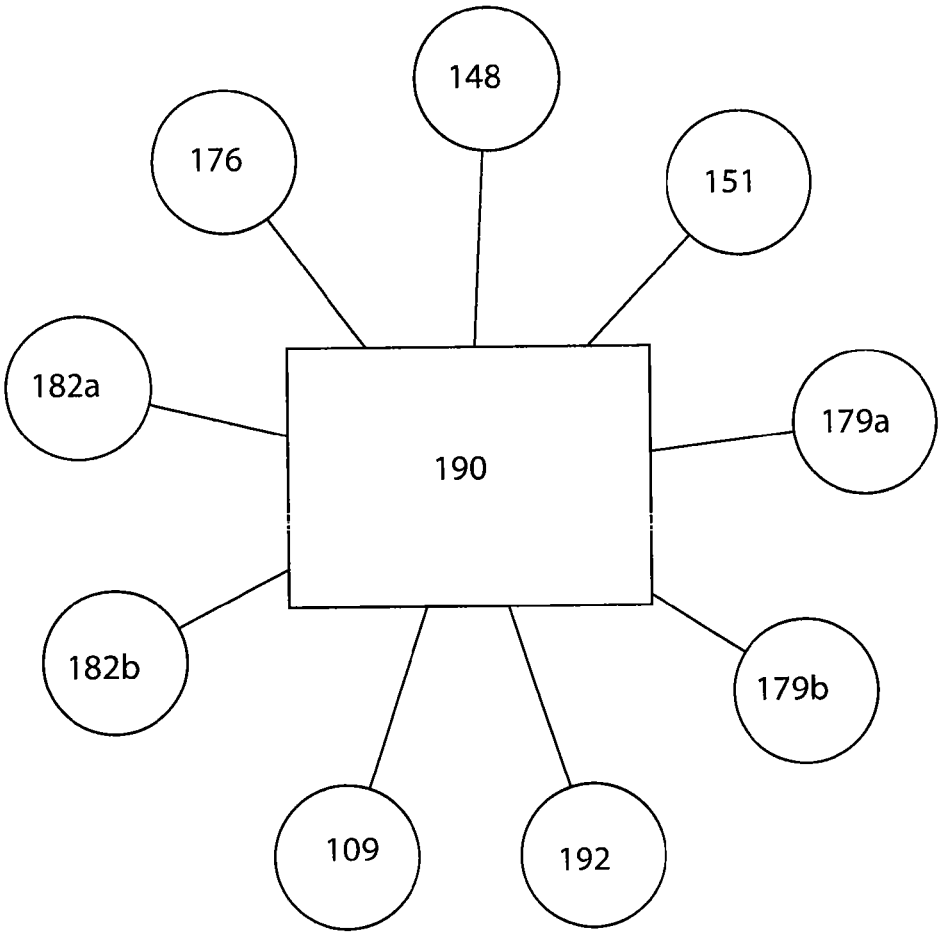

FIG. 16A depicts a simplified schematic block diagram of the circuitry of the machine of FIGS. 1 and 2.

Figure 16B:
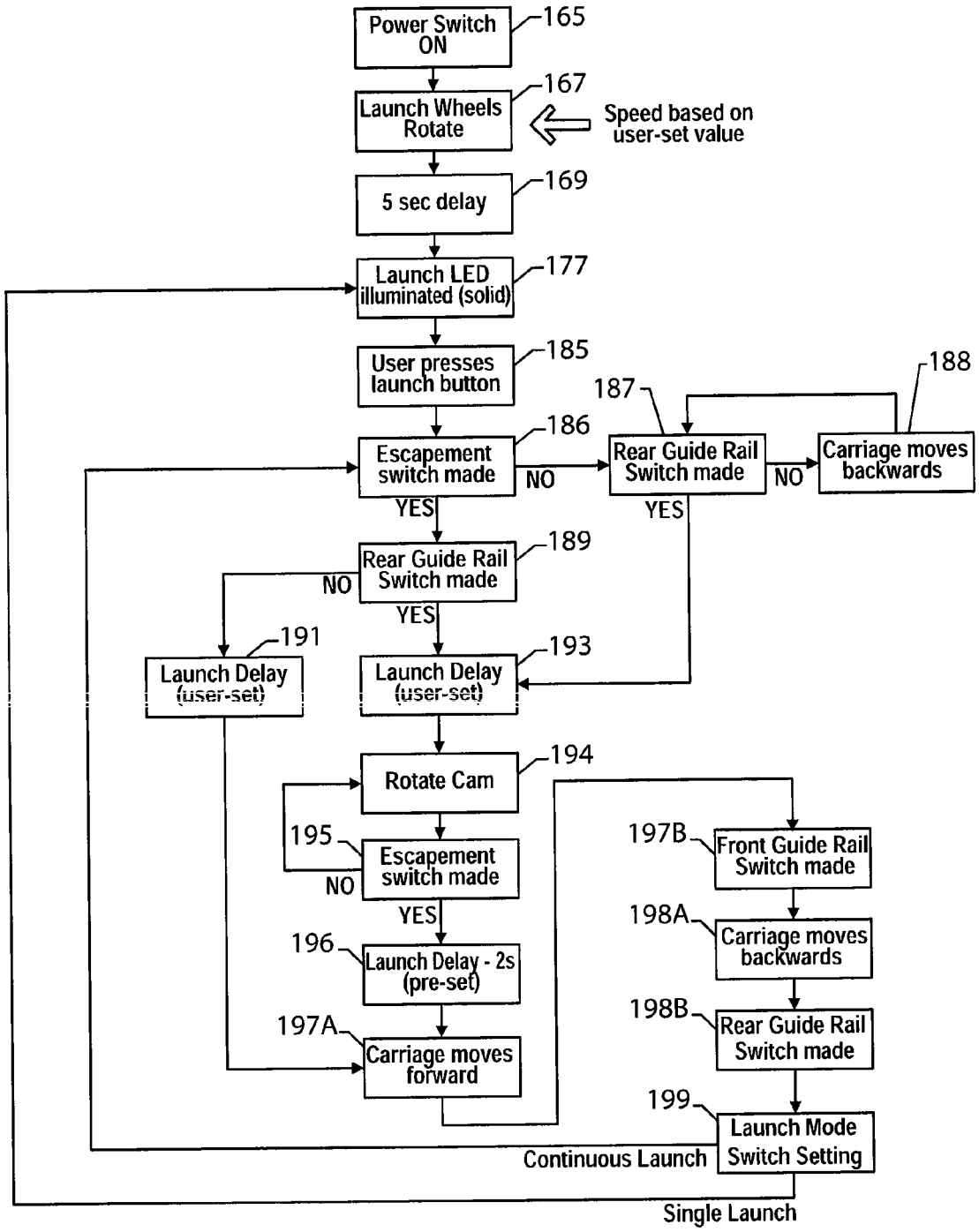

FIG. 16B depicts a flow chart representing a launch sequence of the machine of FIGS. 1 and 2.

Figure 18:
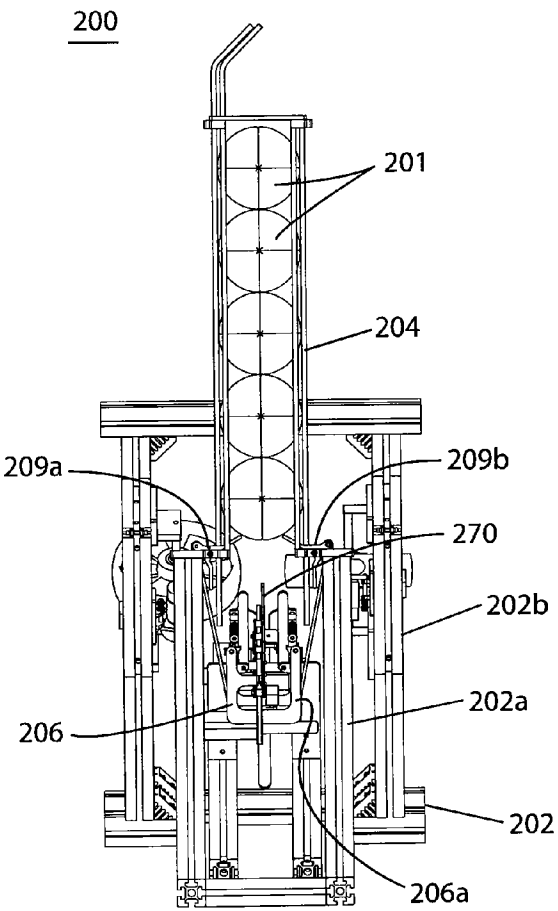
Figure 17:
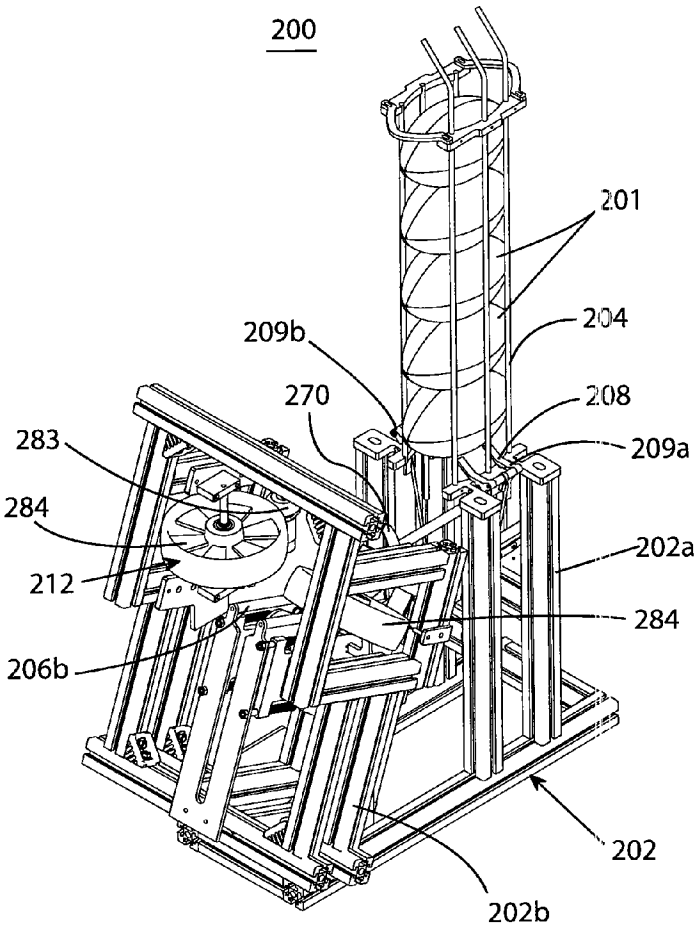

FIGS. 17 and 18 depict front perspective and rear elevation views, respectively, of a second football passing machine, according to a second exemplary embodiment of the invention.

Figure 19:
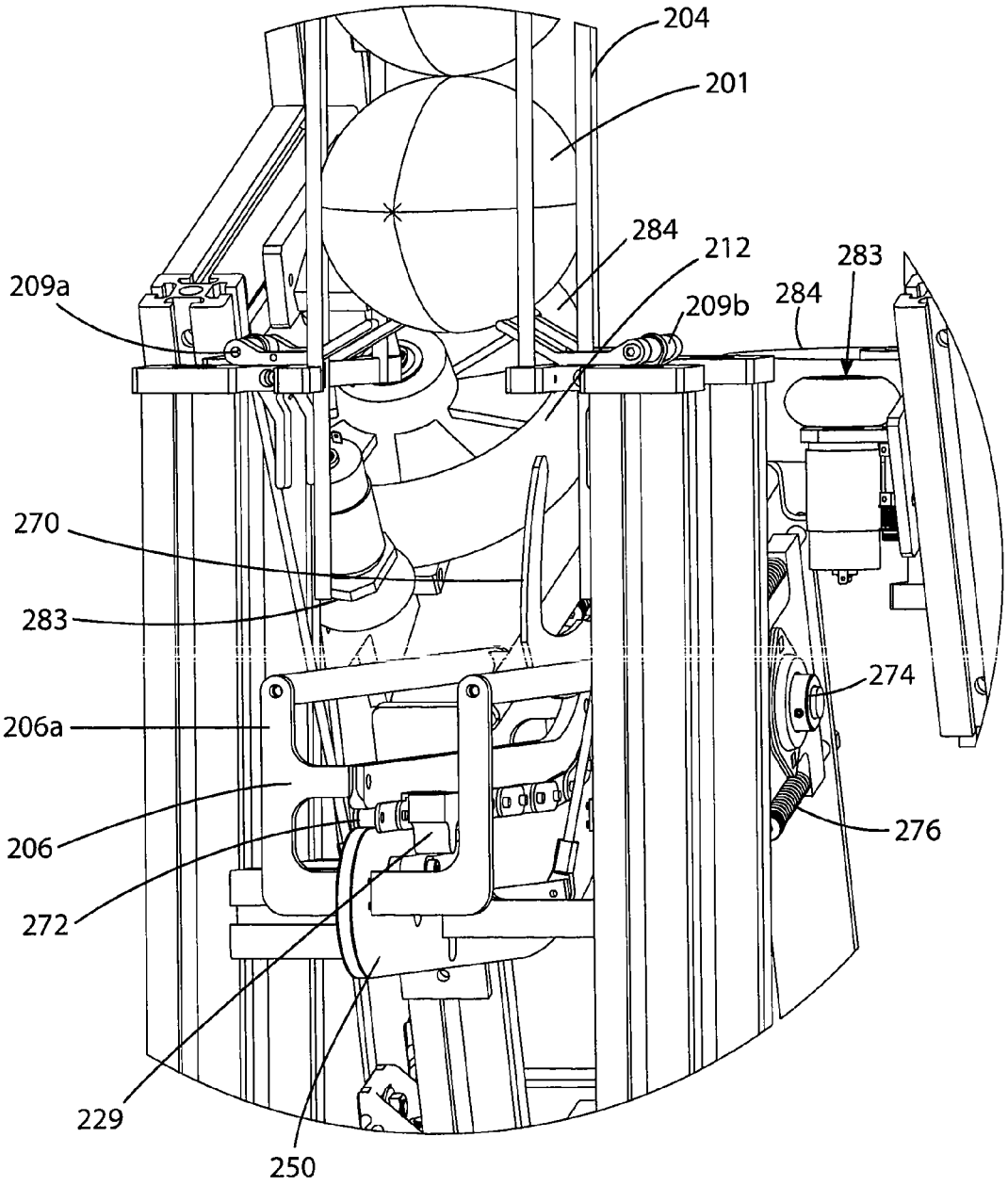

FIG. 19 depicts a detailed perspective view taken from the rear side of the second machine of FIGS. 17 and 18.

Figure 20:
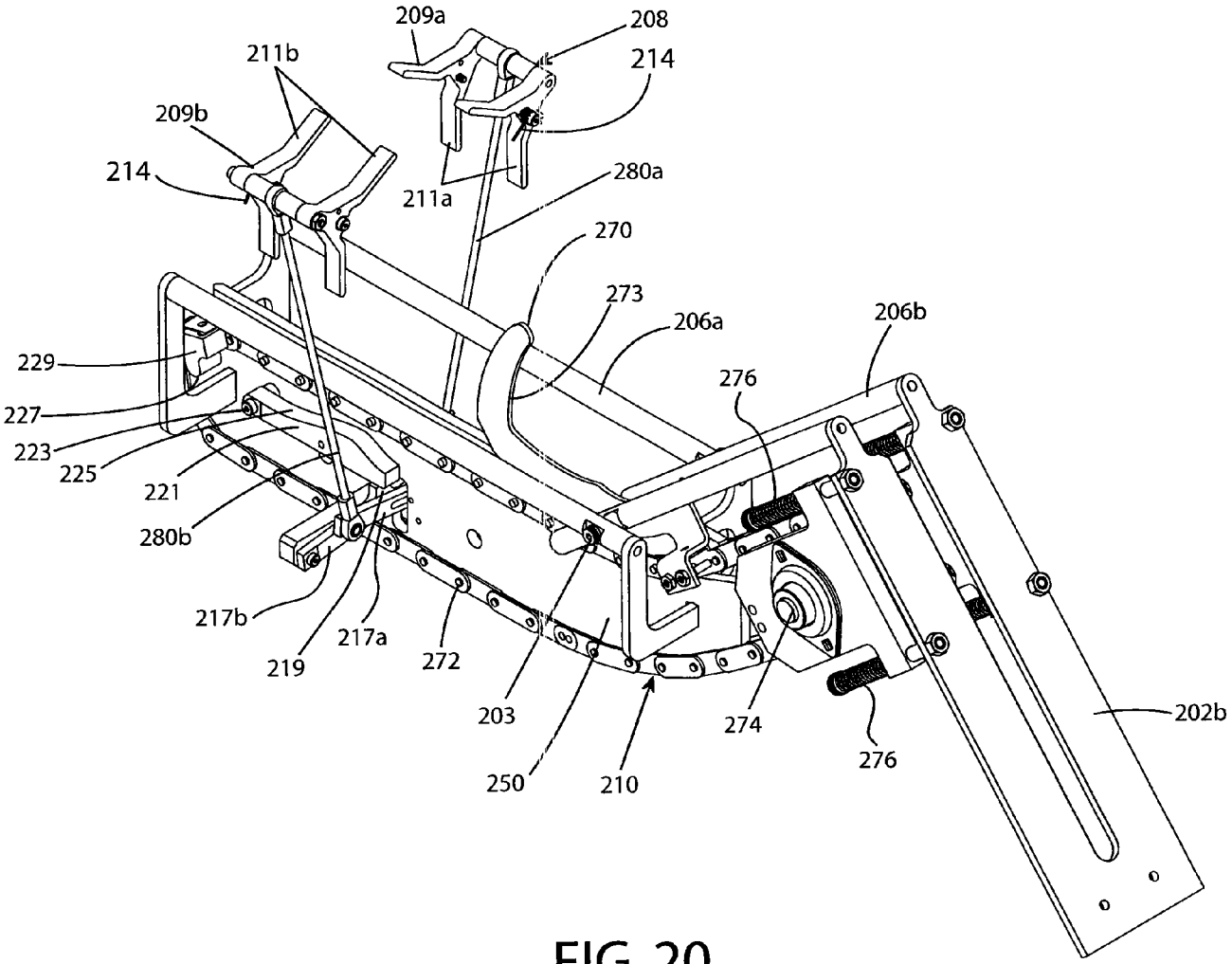

FIG. 20 depicts a partial assembly of the second machine including the ball guidance rail assembly, the escapement arm assembly and the ball carriage assembly, wherein several components of the machine have been omitted for the purpose of clarity.

FIGS. 21A-21D depict the ball carriage assembly moving a football from a first point beneath the ball magazine to a second point adjacent the launch wheel assembly, wherein several components of the machine have been omitted for the purpose of clarity.

FIGS. 22A-22D depict the escapement arm assembly releasing a football onto the ball guidance rail assembly of the second machine.

DETAILED DESCRIPTION OF THE DRAWING FIGURES

The invention will next be illustrated with reference to the figures. Such figures are intended to be illustrative rather than limiting and are included herewith to facilitate explanation of the present invention. In the figures, like item numbers refer to like elements throughout.

FIGS. 1-16B depict a first exemplary embodiment of a football passing machine 100, and FIGS. 17-22 depict a second exemplary embodiment of a football passing machine 200.

Referring now to the football passing machine 100 shown in FIGS. 1-16B, the football passing machine 100 (referred to hereinafter as machine 100) includes a structural frame 102. As best shown in FIGS. 3-6, the frame 102 is composed of tubes, bars and plates that are fastened, welded or otherwise connected together. The components of the frame 102 may be composed of steel, aluminum, plastic, or any other material that is sufficiently durable. The frame 102 includes a handle 103 and wheels 105 that are employed together for transporting the machine 100.

FIGS. 1 and 2 depict an outer casing 104 that is fixedly mounted to the frame 102 by fasteners for concealing many of the Internal components of the machine 100. The outer casing 104 is composed of a molded polymeric material and generally consists of a main body portion 128 and a front cover 130 that is mounted to the main body portion 128. The outer casing 104 includes an oval-shaped forward facing opening 120 (see FIG. 1) through which the footballs are ejected. While the shape of the opening 120 is shaped and sized to accommodate prolate-spheroid-shaped footballs, those skilled in the art will recognize that the shape and size of the opening 120 may vary to accommodate sporting balls of different shapes and sizes.

A rear facing opening 122 (see FIG. 2) is defined on the rear end of the casing 104 through which the handle 103 of the frame 102 and a portion of a ball guidance rail assembly 106 protrude. Although not shown, a cover may be provided over the rear facing opening 122 to conceal the protruding portion of the ball guidance rail assembly 106. Two access openings 124, only one of which is shown, are disposed on the right and left side walls of the outer casing 104 for viewing and/or accessing the internal components of the machine 100. A removable access cover (not shown) may be positioned over each access opening 124. Another opening 126 is provided in a vertically protruding portion of the casing 104 through which a vertical ball magazine 114 extends. The ornamental design of the outer casing 104 may be separately protected by one or more U.S. design patents.

A user interface in the form of a control panel 109 is provided on the outer casing 104, as shown. Although not shown, the control panel 109 may include a screen display and one or more user controls for controlling operation of the machine 100, as will be described later. The machine 100 may also be remotely operated.

FIGS. 3-6 depict the vertical ball magazine 114 of the machine 100. The vertical ball magazine 114 comprises a lower funnel portion 114*a* in which two footballs may be stored, and an upper storage portion 114*b* mounted above the lower funnel portion 114*a* in which additional footballs may be stored. The magazine 114 may be mounted to the frame 102 or the outer casing 104.

The top end of the storage portion 114*b* includes an oval-shaped opening 115 through which footballs are positioned in the vertical ball magazine 114. The storage portion 114*b* includes a oval-shaped vertically extending interior space extending from the opening 115. The oval-shaped vertically extending interior space is sized for accommodating a plurality of footballs 101 that are tightly stacked on top of one another. The perimeter of the oval-shaped vertically extending interior space is slightly larger than the perimeter of a standard football to maintain the footballs 101 in the proper orientation, as shown.

Although not shown, the storage portion 114*b* may be telescoping such that its height is adjustable to either increase or decrease the number of footballs that it can accommodate. Alternatively, the height of the vertical ball storage portion 114*b* may be fixed, as shown. The storage portion 114*b* of the ball magazine 114 is an optional component of the machine 100 and may be omitted entirely.

FIGS. 5, 6 and 12A-14 depict an escapement arm assembly 108 of the machine 100. The escapement arm assembly 108 is configured for successively releasing a single football 101 (i.e., one football at a time) onto a ball guide rail assembly 106 of the machine 100. FIGS. 12A-C depict the escapement arm assembly releasing a football 101*a* onto the ball guidance rail assembly 106. The escapement arm assembly 108 moves between a home position (depicted in FIGS. 12A and 12C) and a cradling position (depicted in FIG. 12B).

Figure 5:
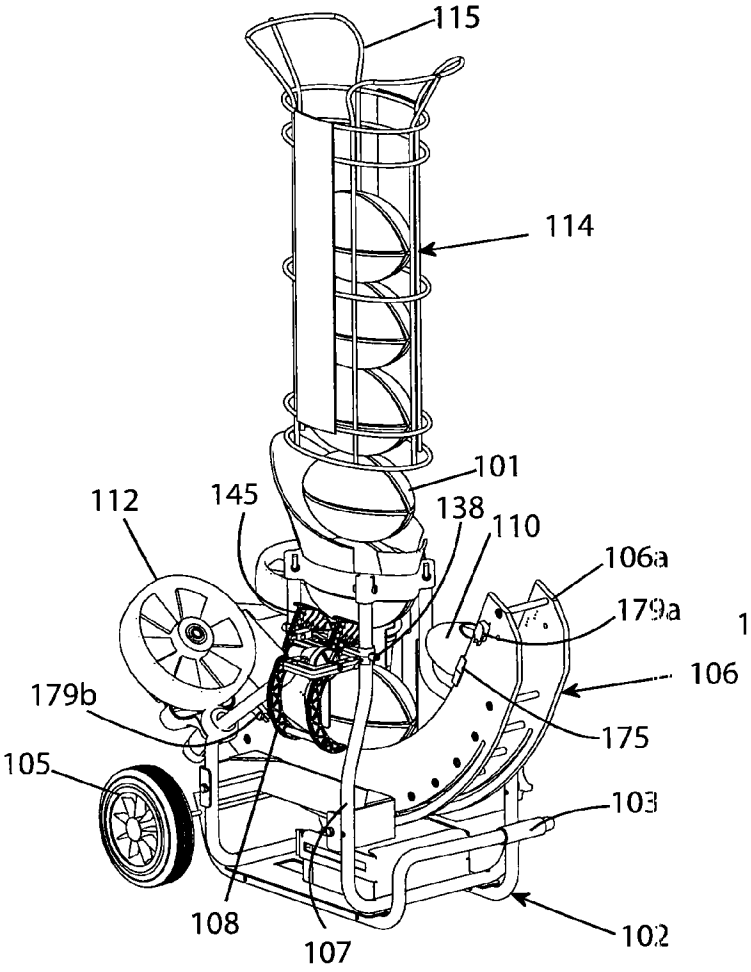

As best shown in FIGS. 5, 13 and 14, the escapement arm assembly 108 includes two brackets 138 that are each fixedly mounted to a vertically-extending tube 107 of the frame 102. Each bracket 138 extends from a support member 144 of the escapement arm assembly 108. The remaining components of the escapement arm assembly 108 are mounted either directly or indirectly to the support member 144.

Referring now to FIGS. 13 and 14, the escapement arm assembly 108 includes a motor-driven cradle 140 that is pivotably mounted to the support member 144. The cradle 140 is pivotably connected to a support member 144 by pin fasteners 149 (see FIG. 14). It should be understood that the cradle 140 pivots with respect to the support member 144 and the frame 102, and the support member 144 is stationary.

The cradle 140 includes two cradle arms 140*a* and 140*b*. The cradle arms 140*a* and 140*b* are structurally and functional equivalent. Each cradle arm 140*a* and 140*b* includes a concave interior surface 142 for cradling and retaining a single football 101. The top end of cradle arm 140*a* and 140*b* includes a convex blocking surface 145. As best shown in FIG. 12C, when the cradle 140 is maintained in the home position, the blocking surface 145 acts as a stop for a football 101*b* loaded in the ball magazine 114 that resides directly above the football 101*a* that is positioned on the ball guide rail assembly 106.

The cradle arms 140*a* and 140*b* of the cradle 140 are horizontally spaced apart by cross-wise members 141*a*, 141*b* and 141*c* by a pre-determined distance that is selected for adequately cradling a football. The cradle arms 140*a* and 140*b* are interconnected together by a support member 144, at least three structural cross-wise members 141*a*, 141*b* and 141*c* and a series of mechanical fasteners. The cradle arms 140*a* and 140*b* of the cradle 140 are interconnected together to form the cradle 140. Thus, the cradle arms 140*a* and 140*b* pivot together.

A release bar 143 is fixedly mounted to the support member 144. As the cradle 140 moves from the cradling position of FIG. 12B toward the home position of FIG. 12C, the release bar 143 urges a football 101*a* onto the guide rail assembly 106 and away from the cradle 140. When the cradle 140 is maintained in the cradling position of FIG. 12B, the release bar 143 either does not contact the football 101*a* or makes limited contact with the football 101*a*.

Referring specifically to FIGS. 13 and 14, the escapement arm assembly 108 includes a motor 148 that is mounted to the support member 144. Operation of the motor 148 is controlled by a computer processor of the machine 100. The rotating output shaft of the motor 148 is connected to an eccentric cam 146 for rotating the eccentric cam 146 about a pin 150 that is connected to the cam 146. The outer surface of the eccentric cam 146 bears on a cam follower 147 (see FIG. 14). The cam follower 147 is a rotatable sleeve that is mounted on the cross-wise member 141*c*, and spins freely on the cross-wise member 141*c*. During operation, rotation of the cam 146 by the motor 148 causes the outer surface of the eccentric cam 146 to bear on the cam follower 147 which causes the cradle 140 to pivot about the pin fasteners 149. Although not explicitly shown, a spring biases the cradle 140 toward the home position of FIG. 12A.

The escapement arm assembly 108 includes means for sensing the position of the cradle 140 in the form of a limit switch 151. The limit switch 151 is mounted on the top end of the support member 144. The limit switch 151 is configured to sense the presence of a protrusion 153 that extends from the interior facing side of the cradle arm 140*b*. The protrusion 153 contacts the switch 151, as shown in FIG. 13, when the escapement arm assembly 108 is maintained in the home position shown in FIGS. 12A and 12C. In the home position shown in FIGS. 12A and 12C, the cradle 140 is sufficiently spaced from the ball guide rail assembly 106.

In operation, the limit switch 151, which is connected to a computer processor of the machine 100, transmits a signal to the computer processor of the machine 100 when the protrusion 153 contacts the switch 151, signifying that the escapement arm assembly 108 is maintained in the home position.

According to this exemplary embodiment, the means for sensing the position of the cradle 140 is a limit switch 151, however, the means for sensing the position of the cradle 140 could be a proximity sensor, a position sensor or a Hall-effect sensor, for example. Those skilled in the art will recognize that other ways of sensing the rotational position of the cradle 140 exist.

Figure 8:
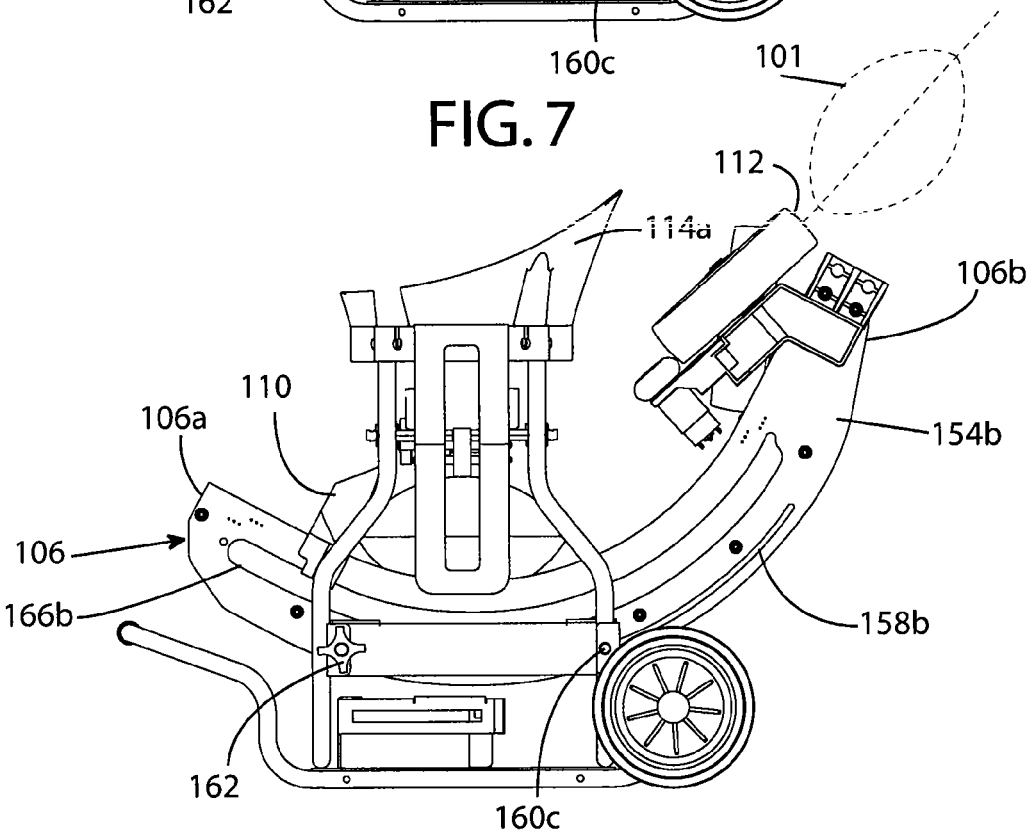
Figure 9:
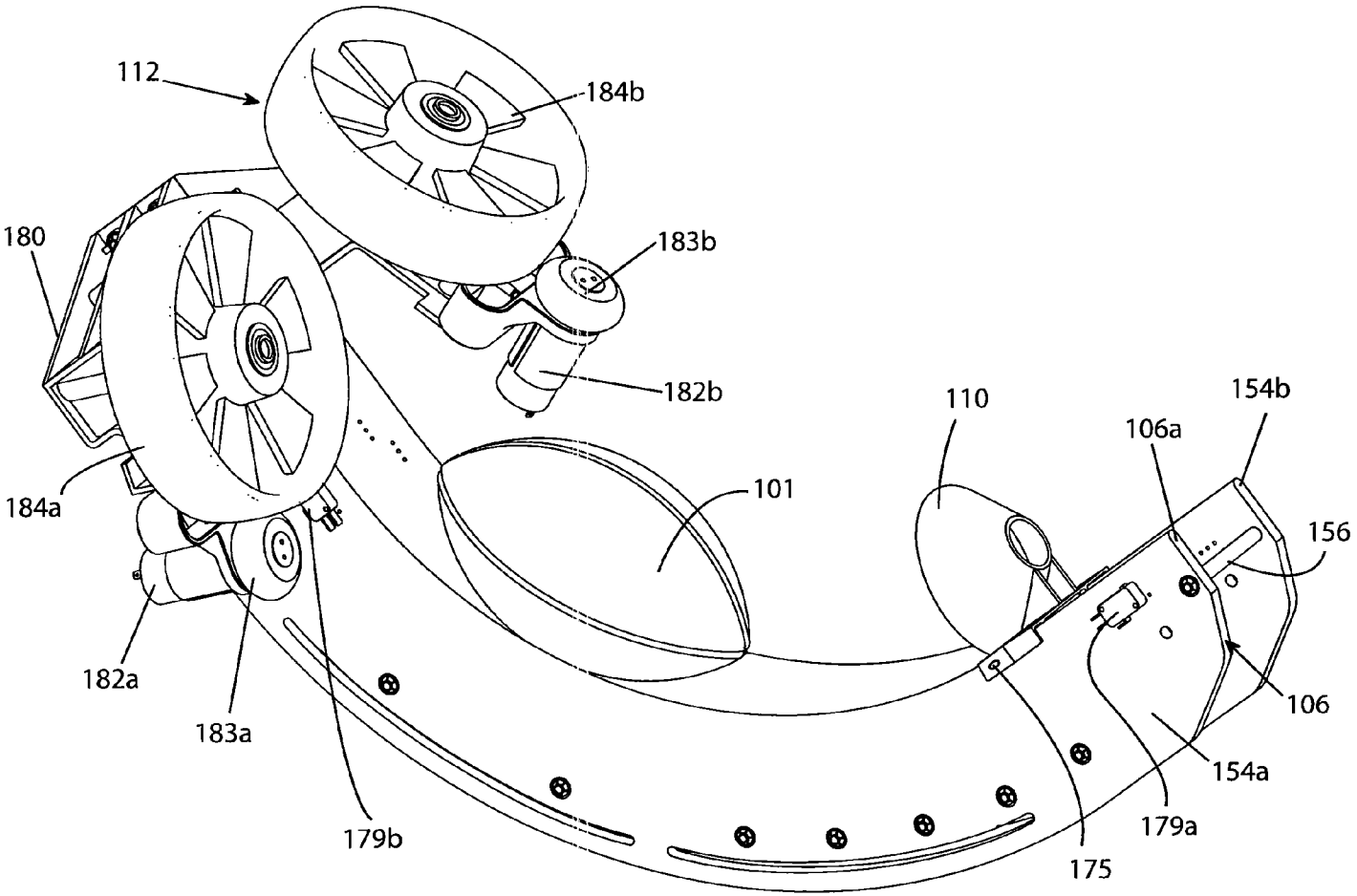
FIGS. 9 and 10 are perspective views taken from the rear and left sides, and the rear and right sides, respectively, of a subassembly of the machine of FIGS. 1 and 2 showing the interrelationship between a football, a guide rail assembly, a launch wheel assembly, and a reciprocating ball carriage assembly of the machine.
Figure 10:
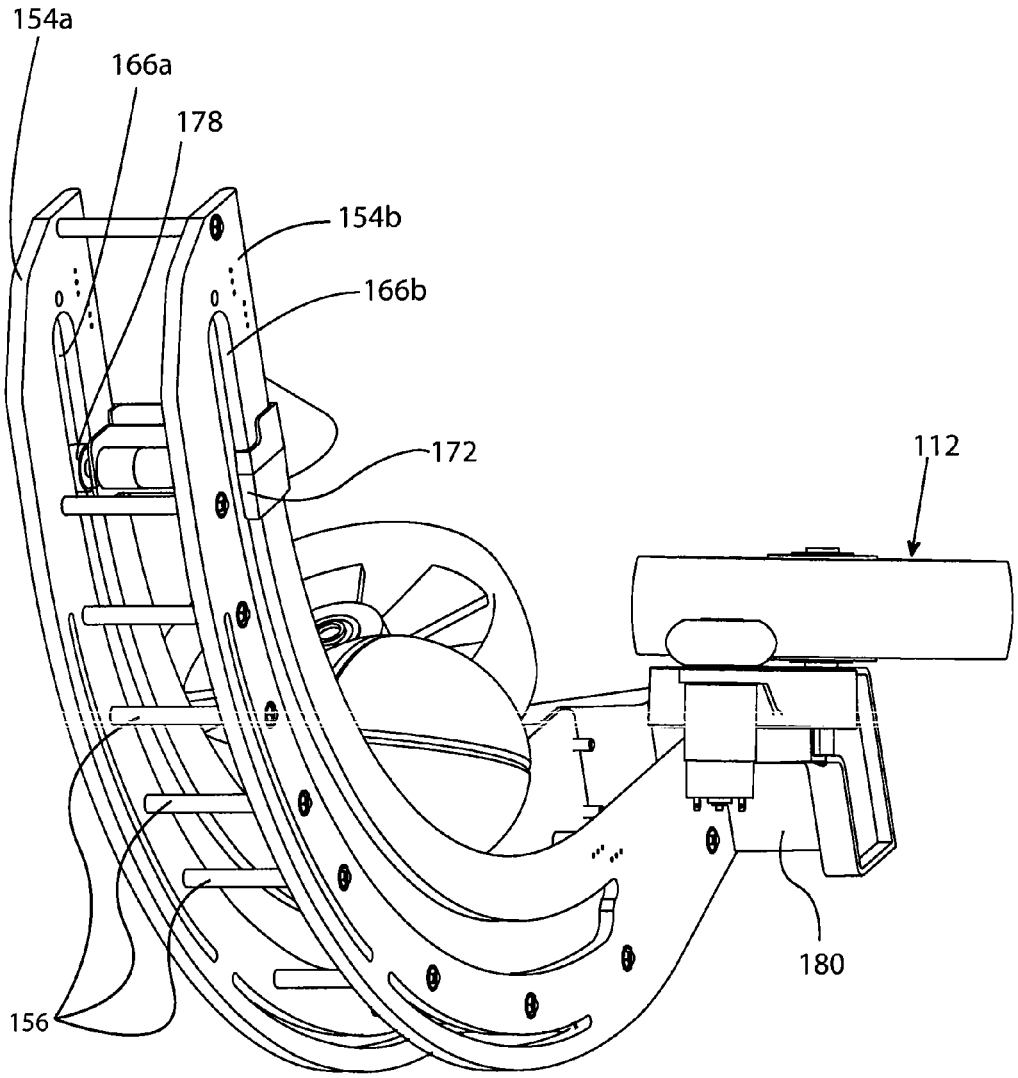

FIGS. 3-10 depict the ball guide rail assembly 106 of the machine 100. The ball guide rail assembly 106 defines a curved launch surface upon which the football 101 is moved. As best shown in FIG. 10, the ball guide rail assembly 106 (hereinafter rail assembly 106) generally includes two rail sections 154*a* and 154*b* that are interconnected by a series of structural cross-wise members 156. The rail sections 154*a* and 154*b* are horizontally spaced apart by a pre-determined distance that is suitable for accommodating a standard-sized football.

As best shown in FIGS. 12A-12C, a length of tubing 155 having a rounded outer surface is mounted to the top edge of each rail section 154*a* and 154*b*. The tubing 155 is shown in cross-section in FIGS. 12A-12C and has been omitted from the other views that depict the rail sections 154*a* and 154*b*. The outer surface of the tubing 155 forms the launch surface of the machine 100 that is recited in the claims. In operation, the football 101 and the ball carriage assembly 110 both ride directly on the outer surface of the tubing 155. To reduce friction between the tubing 155, the ball carriage assembly 110 and the football 101, the tubing 155 is either composed of or is coated with a material having a low coefficient of friction. According to one aspect of the invention, the coefficient of friction of the tubing 155 is less than that of the rail sections 154*a* and 154*b*. Alternatively, the tubing 155 may be omitted, in which case the top edges of the rail sections 154*a* and 154*b* would represent the launch surface of the machine 100. If the tubing 155 is omitted, a material having a low coefficient of friction, such as a Teflon coating, may be applied to the top edges of the rail sections 154*a* and 154*b*. Those skilled in the art will recognize other ways of preparing a launch surface having a relatively low coefficient of friction.

Figure 6:
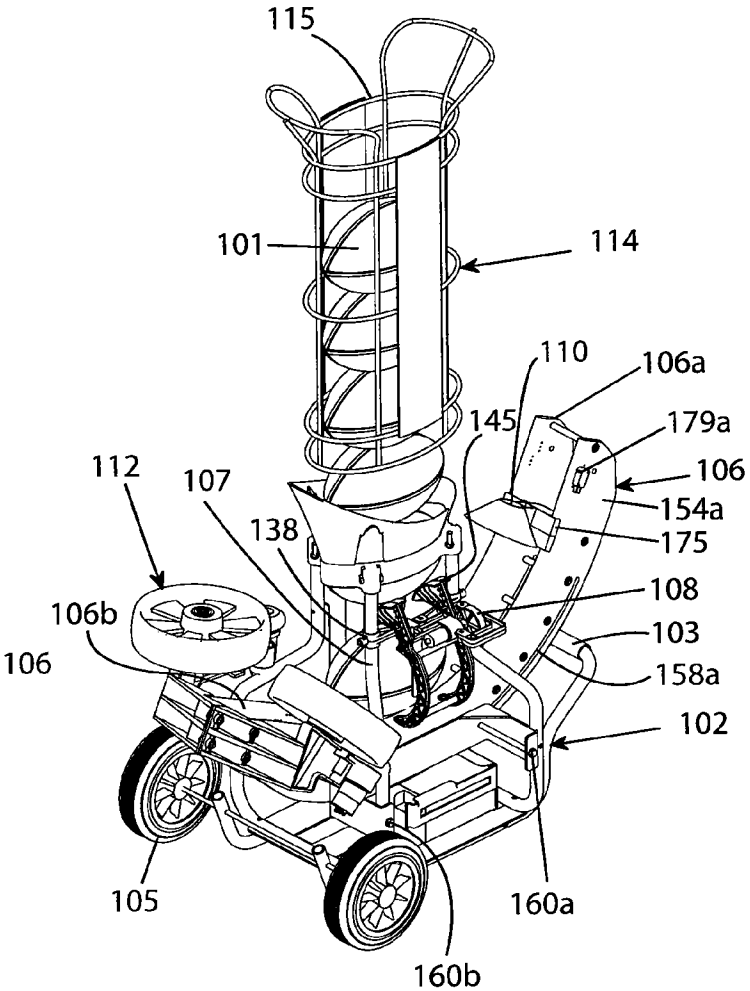

The rail assembly 106 is pivotably mounted to the frame 102 of the machine 100. The position of the ball guide rail assembly 106 is capable of being manually adjusted so as to adjust the launch angle and the trajectory of a football that is ejected by the launch wheel assembly 112 of the machine 100. As shown in FIG. 6, the rail section 154*a* includes a curved slot 158*a* in which two pins 160*a* and 160*b* of the frame 102 are positioned. The pins 160*a* and 160*b* of the frame 102 are each fixedly mounted to the frame 102. The curved slot 158*a* of the rail section 154*a* is capable of sliding over the pins 160*a* and 160*b*.

Figure 4:
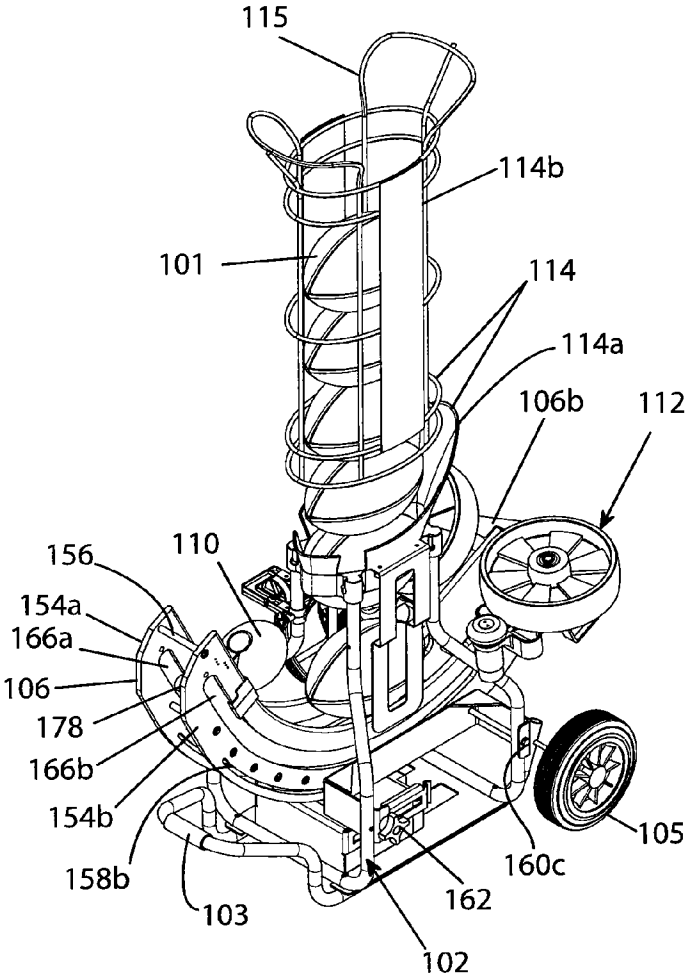
Figure 7:
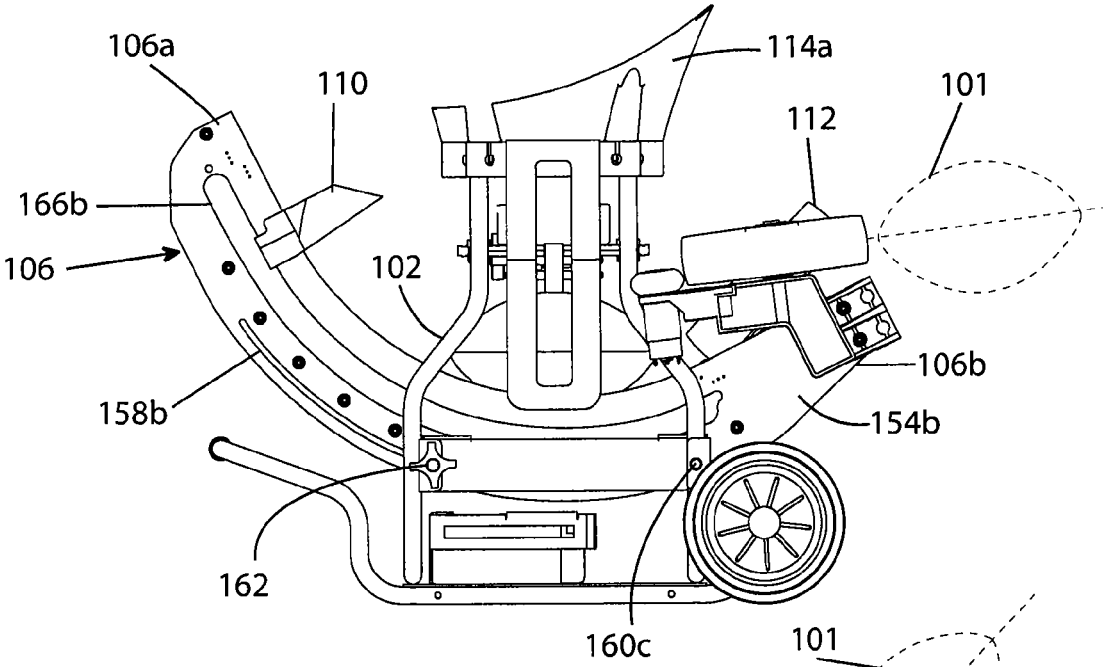
FIGS. 7 and 8 are detailed right side elevation views of the machine of FIGS. 1 and 2, with the outer casing removed, depicting different positions of a pivotable guide rail assembly of the machine.

As shown in FIGS. 4, 7 and 8, the other rail section 154*b* of the rail assembly 106 includes a curved slot 158*b* in which one adjustable fastener 162 and one pin 160*c* of the frame 102 are positioned. The pin 160*c* of the frame 102 is fixedly mounted to the frame 102. The slot 158*b* of the rail section 154*b* is capable of sliding over the pin 160*c*. The adjustable fastener 162 is threadedly connected to both the frame 102 and the slot 158*b* of the rail section 154*b*. In a loosened state of the fastener 162, the slot 158*b* of the rail section 154*b* is capable of sliding over the fastener 162, whereas, in a tightened state of the fastener 162, the fastener 162 is fixed to the slot 158*b* thereby locking the rail assembly 106 in a fixed position.

Loosening the fastener 162 enables an operator of the machine 100 to manually adjust the position of the rail assembly 106 with respect to the frame 102 (compare the position of the rail assembly 106 in FIGS. 7 and 8). The pins 160*a*-160*c* and their respective slots 158*a* and 158*b* guide the pivoting movement of the rail assembly 106. Adjusting the position of the rail assembly 106 changes the launch angle and the trajectory of a football that is ejected by the launch wheel assembly 112 of the machine 100 (compare the broken line football trajectories in FIGS. 7 and 8). Regardless of the position of the rail assembly 106, a football is dropped onto the rail assembly 106 in a horizontal orientation whereby the longitudinal axis of the football is substantially perpendicular to the axis of the vertical ball magazine 114.

Tightening the fastener 162 fixes the rail assembly 106 with respect to the frame 102, thereby preventing inadvertent movement of the rail assembly 106 during operation of the machine 100. Although not shown, the ball guide rail assembly 106 may be connected to a motor for automatically adjusting the position of the rail assembly 106 with respect to the frame 102.

Although not shown, a rotatable platform may be positioned beneath the machine 100 to facilitate rotation of the machine 100, thereby changing the direction of the ejected footballs. Rotation of the rotatable platform may be manual or automated.

Referring still to FIGS. 4, 7 and 8, the rail sections 154*a* and 154*b* are structurally equivalent. The rail sections 154*a* and 154*b* include curved recesses 166*a* and 166*b*, respectively, that cooperate with the reciprocating ball carriage assembly 110. As best shown in FIG. 4, the recess 166*a* is formed on the inner facing surface of the rail section 154*a*, whereas the recess 166*b* is formed on the outer facing surface of the rail section 154*b*. The recesses 166*a* and 166*b* do not pass through the entire thickness dimension of the rail sections 154*a* and 154*b*, respectively. Further details of the recesses 166*a* and 166*b* will be described hereinafter with respect to the reciprocating ball carriage assembly 110.

FIGS. 3-6, 9, 10, 15A and 15B depict the reciprocating ball carriage assembly 110 (hereinafter carriage assembly 110) of the machine 100. The carriage assembly 110 is moveably mounted to the guide rail assembly 106. The carriage assembly 110 is capable of moving between a first position where the carriage assembly 110 is located near a proximal end 106*a* of the guide rail assembly 106, and a second position where the carriage assembly 110 is located near a distal end 106*b* of the guide rail assembly 106.

As best shown in FIGS. 15A and 15B, the carriage assembly 110 generally includes a support member 168 upon which the other components of the carriage assembly 110 are either directly or indirectly mounted. The support member 168 includes a cone 171 defining a substantially conically-shaped interior surface 173 in which one end of a football 101 is positioned during operation. The shape of the interior surface 173 is not limited to being conical, as it may vary to accommodate the shape of any sports ball (e.g., tennis ball, rugby ball, baseball, soccer ball, etc.). Although the cone 171 is shown as being integrally formed on the support member 168, the cone 171 and the support member 168 may be discrete components that are connected together.

As best shown in FIGS. 10, 15A and 15B, a recess 170 that is formed on one end of the support member 168 is sized to receive the top edge of the rail section 154*b* of the rail assembly 106. A flange 172, which extends in an inward direction from said one end of the support member 168, is positioned in the recess 166*b* of the rail section 154*b*. Another recess 174 that is formed on an opposite end of the support member 168 is sized to receive the top edge of the rail section 154*a* of the rail assembly 106.

A motor 176 is mounted to the underside of the support member 168. Operation of the motor 176 is controlled by a computer processor of the machine 100. The motor 176 is capable of rotating its output shaft in two different rotational directions. The rotatable output shaft of the motor 176 is connected to a wheel 178. As best shown in FIG. 10, the wheel 178 is positioned to travel in the recess 166*a* of the rail section 154*a* of the rail assembly 106. As shown in FIG. 15B, a tension spring 181, which is indirectly connected to the wheel 178, urges the wheel 178 in an upward direction against the top surface of the recess 166*a* of the rail section 154*a*. The carriage assembly 110 is captivated onto the guide rail assembly 106 by the wheel 178, as well as the flange 172. In operation, the motor 176 rotates the wheel 178 causing the wheel 178 to travel along the recess 166*a* of the rail section 154*a*. The entire carriage assembly 110 moves along with the wheel 178.

The machine 100 includes means for sensing the position of the carriage assembly 110 in the form of two limit switches 179*a* and 179*b*. As best shown in FIG. 9, one limit switch 179*a* is mounted on the proximal end 106*a* of the guide rail assembly 106 and the other limit switch 179*b* is mounted on the distal end 106*b* of the guide rail assembly 106. The flange 175 of the carriage assembly 110 is sized to come into contact with the switches 179*a* and 179*b*. Each switch 179*a* and 179*b* is connected to the computer processor of the machine 100, and each switch 179*a* and 179*b* transmits a signal to the computer processor of the machine 100 once it is activated by the flange 175 of the carriage assembly 110. The means for sensing the position of the carriage assembly 110 could also be a proximity sensor, a position sensor or a Hall-effect sensor, for example.

Based upon the signals transmitted to the computer processor by the limit switches 179*a* and 179*b*, the computer processor of the machine 100, which is also connected to the motor 176 of the carriage assembly 110, causes the motor 176 to either reverse its direction of rotation or stop, as will be described in greater detail with reference to FIG. 16B.

Figure 11:
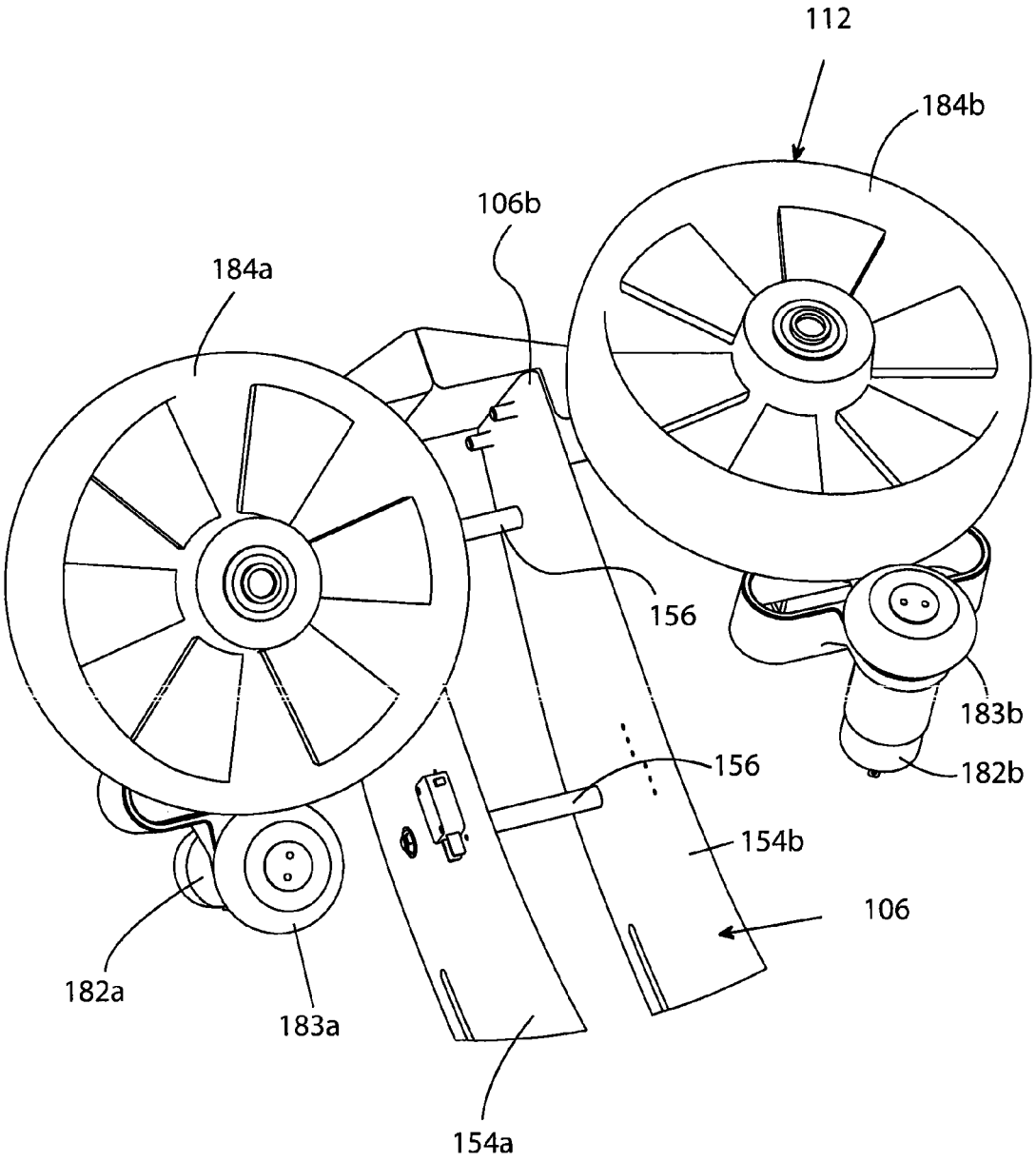
FIG. 11 is a detailed view of the subassembly of FIG. 9 depicting the launch wheel assembly mounted to the distal end of the pivotable guide rail assembly.

FIGS. 9-11 depict the launch wheel assembly 112 of the machine 100. The launch wheel assembly 112 may also be referred to as a football launch mechanism. The wheel assembly 112 is fixedly mounted to the distal end 106*b* of the guide rail assembly 106. As best shown in FIGS. 9-11, the wheel assembly 112 generally includes a support bracket 180 that is connected to the distal end 106*b* of the guide rail assembly 106 by a series of fasteners. The remaining components of the wheel assembly 112 are connected, either directly or indirectly, to the bracket 180.

More particularly, the motors 182*a* and 182*b* are mounted to opposing sides of the bracket 180. Output shafts of the motors 182*a* and 182*b* rotate small friction drive wheels 183*a* and 183*b*, respectively, in opposite directions. The small friction drive wheels 183*a* and 183*b* are positioned in direct contact with much larger launch wheels 184*a* and 184*b*, respectively. The axes of the launch wheels 184*a* and 184*b* are offset, similar to many other conventional football passing machines, such as disclosed in U.S. Pat. No. 4,026,261. Rotation of the friction drives wheels 183*a* and 183*b* causes the launch wheels 184*a* and 184*b*, respectively, to rotate in opposite directions. The rotating launch wheels 184*a* and 184*b* are employed to launch a football 101 that is fed by the reciprocating ball carriage assembly 110, as will be described later.

Because the wheel assembly 112 is fixedly mounted to the guide rail assembly 106, the wheel assembly 112 pivots along with the guide rail assembly 106. It should be understood that the components of the launch wheel assembly 112 do not pivot with respect to the bracket 180 upon moving the guide rail assembly 106.

Various conventional football passing machines utilize launch wheels that are directly attached to the motor shafts. Such designs typically require powerful motors and precise wheel-to-shaft mounting and isolation using bearings. In comparison, the launch wheel assembly 112 of the machine 100 isolates the shafts of the motors 182*a* and 182*b* from the launch wheels 184*a* and 184*b*, respectively, such that less powerful and less expensive motors 182*a* and 182*b* can be used and fixation of the launch wheel shafts can be less exact.

The gear reduction effect that is created by using friction drives wheels 183*a* and 183*b* having a smaller diameter than that of the launch wheels 184*a* and 184*b*, permits the use of smaller, high RPM motors 182*a* and 182*b* to achieve the same launch wheel speed as conventional passing machines. Thus, the launch wheel assembly 112 offers the same launch wheel speed as conventional football passing machines having launch wheels that are directly attached to the motor shafts using less powerful and less expensive motors 182*a* and 182*b*.

Alternatively, and although not shown, the shafts of the motors 182*a* and 182*b* may be attached to the shafts of the launch wheels 184*a* and 184*b* by drive belts to yield the same benefits that are described above.

FIG. 16A depicts a simplified schematic block diagram of the circuitry of the machine 100. According to FIG. 16A, the computer processor 190, which is powered by a power supply 192, receives signals from the control panel 109 and the switches 151, 179*a* and 179*b*. Based upon those signals, the computer processor 190 operates the motors 148, 176, 182*a* and 182*b* of the machine 100. The control panel 109, the motors and the switches of the machine 100 communicate with the computer processor 190 of the machine 100 either wirelessly or via wired connections.

One exemplary method of operating the machine 100 to pass footballs will now be described with respect to FIG. 16B. It should be understood that the description of the exemplary method may vary from that which will be described and is not limited to any particular sequence or steps.

Prior to activating the machine 100, if the operator of the machine 100 desires to adjust the trajectory of the football ejected by the machine 100, then the operator first loosens the fastener 162. The operator then pivots the guide rail assembly 106 to any desired location in order to achieve a desired trajectory of the football. The operator then retightens the fastener 162 to secure the guide rail assembly 106 in place.

The operator then loads one or more footballs 101 into the vertical ball magazine 114. As the footballs 101 are loaded into the magazine 114, the footballs 101 land on top of one another in the appropriate orientation due to the geometry of the vertical ball magazine 114. As shown in FIG. 12A, the lower-most football in the funnel portion 114*a* of the magazine comes to rest in the appropriate orientation against the blocking surfaces 145 of the escapement arm assembly 108, which is initially maintained in the home position of FIG. 12A.

Referring now to FIG. 16B, at step 165 of the launch sequence, the operator activates the power button of the machine 100 and the sequence proceeds to step 167. At step 167, the computer processor 190 of the machine 100 activates the motors 182*a* and 182*b*, which causes the launch wheels 184*a* and 184*b*, respectively, to rotate in opposite directions. The operator then programs the machine 100 via the control panel 109. Depending upon the functionality of the machine 100, the operator may set the speed of the launch wheels 184*a* and 184*b*, the time delay in launching successive footballs, and/or set the football passing mode of the machine 100 via the control panel 109.

The machine 100 optionally has a single launch mode and a continuous launch mode. In the single launch mode, the machine 100 launches a single football and then goes into a standby mode until a launch button is depressed again by the operator. In the continuous launch mode, the machine 100 continuously launches footballs at pre-defined intervals, and the operator sets the pre-defined intervals (e.g., 5 seconds, 10 seconds, etc.) via the control panel 109. These modes will be discussed again later.

At step 169, the machine 100 undergoes a delay (e.g., 5 seconds) and then the sequence proceeds to step 177. At step 177, the computer processor 190 illuminates a 'Launch' LED on the control panel 109. At step 185, the operator depresses a Launch button on the control panel 109.

At step 186, the computer processor 190 verifies whether or not the limit switch 151 of the escapement arm assembly 108 is activated. If the limit switch 151 is activated then the escapement arm assembly 108 is maintained in its home position shown in FIGS. 12A and 12C, and the cradle 140 is sufficiently spaced from the guide rail assembly 106 such that the cradle 140 will not interfere with the reciprocating motion of the ball carriage assembly 110 that moves along the guide rail assembly 106. Alternatively, if the limit switch 151 is not activated, then the escapement arm assembly 108 is not maintained in its home position and could potentially interfere with the ball carriage assembly 110.

If the limit switch 151 is not activated at step 186, then machine proceeds to step 187 of the sequence. At step 187 the computer processor 190 verifies that the limit switch 179*a* of the guide rail assembly 106 is activated. If the limit switch 179*a* is not activated at step 187, then the ball carriage assembly 110 is not maintained in its home position at the proximal end 106*a* of the guide rail assembly 106 and launch sequence proceeds to step 188. At step 188, the computer processor 190 activates the motor 176 of the ball carriage assembly 110 to return the ball carriage assembly 110 to its home position at the proximal end 106*a* of the guide rail assembly 106. Thereafter, the launch sequence returns to step 187 whereupon the computer processor 190 again verifies that the limit switch 179*a* of the guide rail assembly 106 is activated. If the limit switch 179*a* is activated at step 187, then the ball carriage assembly 110 has reached its home position and the launch sequence proceeds to step 193. Steps 187 and 188, which may be referred to as a recovery sequence, are employed to ensure that only one football is positioned on the guide rail assembly 106 at any one time, and to ensure that the ball carriage assembly 110 does not collide with the escapement arm assembly 108.

Referring back to step 186, if the limit switch 151 of the escapement arm assembly 108 is activated at step 186, then the launch sequence proceeds to step 189. At step 189 the computer processor 190 verifies that the limit switch 179*a* of the guide rail assembly 106 is activated. If the limit switch 179*a* is activated at step 189 then the sequence proceeds to step 193.

Alternatively, if the limit switch 179*a* is not activated at step 189 then the sequence proceeds to step 191. At step 191 the machine undergoes a launch delay for a pre-determined amount of time, as set by the operator, and then proceeds directly to step 197A, which will be described in greater detail later. Step 191 also constitutes part of the aforementioned recovery sequence.

Referring back to step 193, at step 193 the machine undergoes a launch delay for a pre-determined amount of time, as set by the operator, and proceeds to step 194. At step 194, the computer processor 190 of the machine 100 instructs the motor 148 (see FIG. 14) of the escapement arm assembly 108 to rotate its output shaft by a single revolution, which rotates the cam 146 by a single revolution. Rotation of the cam 146 pivots the cradle 140 from the home position of FIG. 12A to the cradling position of FIG. 12B. Upon pivoting the cradle 140 in a counterclockwise direction from the home position of FIG. 12A to the cradling position of FIG. 12B, the blocking surfaces 145 of the cradle 140 rotate away from the first football 101*a* in the magazine while the curved surfaces 142 of the cradle 140 rotate toward the first football 101*a*. Consequently, the first football 101*a* falls by gravity onto the curved surfaces 142 of the cradle 140. The first football 101*a* prevents the second football 101*b* from falling further toward the guide rail assembly 106.

A spring (not shown) pivots the cradle 140 in a clockwise direction from the cradling position of FIG. 12B to the home position of FIG. 12C. Upon pivoting the cradle 140 to the home position of FIG. 12C, the curved surfaces 142 of the cradle 140 rotate away from the lowermost football 101*a* as the release bar 143 (see FIG. 12) urges the first football 101*a* onto the top edges of the guide rail assembly 106. It should be understood that the release bar 143 is fixed in position and does not move. In the same clockwise motion of the cradle 140, the blocking surfaces 145 of the cradle 140 come into contact with the second football 101*b* to prevent the second football 101*b* from moving downward.

The launch sequence then proceeds to step 195. At step 195, the computer processor 190 again verifies whether or not the limit switch 151 of the escapement arm assembly 108 is activated. If the limit switch 151 is not activated at step 195, then the sequence returns to step 194 whereupon the computer processor 190 of the machine 100 again instructs the motor 148 (see FIG. 14) of the escapement arm assembly 108 to rotate its output shaft until the limit switch 151 is activated at which time the cradle 140 is in its home position of FIG. 12A. The launch sequence then proceeds back to step 195. This process will continue until the limit switch 151 is activated.

At step 195, the computer processor 190 again verifies whether or not the limit switch 151 is activated. If the limit switch 151 is activated at step 195, then the launch sequence proceeds to step 196. At step 196 the machine undergoes a launch delay for a pre-set amount of time, which may be 2 seconds, and the launch sequence proceeds to step 197A.

At step 197A, it should be understood that the first football 101*a* is positioned on the launch surface of the guide rail assembly 106, the ball carriage assembly 110 is maintained in its home position at the proximal end 106*a* of the guide rail assembly 106, and the launch wheels 184*a* and 184*b* are rotating.

As best shown in FIG. 10, at step 197A, the computer processor 190 of the machine 100 activates the motor 176 of the ball carriage assembly 110 to transport the ball carriage assembly 110 toward the distal end 106*b* of the guide rail assembly 106. More particularly, the motor 176 rotates the wheel 178, causing the wheel 178 of the ball carriage assembly 110 to rotate in the slot 166*a* of the guide rail assembly 106.

As shown in FIG. 8, once the ball carriage assembly 110 arrives at a location on the guide rail assembly 106 that is beneath the ball magazine 114, the conical surface 173 of the ball carriage assembly 110 engages the end of the first football 101*a* that is positioned on the guide rail assembly 106. The ball carriage assembly 110 moves the football 101*a* toward the distal end 106*b* of the guide rail assembly 106 until the end of the football 101*a* contacts the rotating launch wheels 184*a* and 184*b* of the launch wheel assembly 112. At that instant the rotating launch wheels 184*a* and 184*b* of the launch wheel assembly 112 propel the football 101*a* into the air.

Immediately thereafter, at step 197B, the moving ball carriage assembly 110 contacts the limit switch 179*b* (see FIG. 5) on the distal end 106*b* of the guide rail assembly 106, thereby activating the limit switch 179*b*. At step 198A, upon receiving a signal that the limit switch 179*b* has been activated, the computer processor 190 of the machine 100 instructs the motor 176 (see FIG. 15B) of the ball carriage assembly 110 to reverse direction. The motor 176 (see FIG. 15B) of the ball carriage assembly 110 then transports the ball carriage assembly 110 back toward its home position at the proximal end 106*a* of the guide rail assembly 106. Once the ball carriage assembly 110 contacts the limit switch 179*a* (see FIG. 5) on the proximal end 106*a* of the guide rail assembly 106, at step 198B, the launch sequence proceeds to step 199.

At step 199 the computer processor 190 of the machine 100 determines whether the machine 100 is set to the single launch mode or the continuous launch mode, as selected by the operator. If the machine is set to a continuous launch mode, then the launch sequence returns to step 186 and the machine 100 ultimately launches the second football 101*b* as well as the remaining footballs in the magazine 114 of the machine 100. Alternatively, if the machine is set to a single launch mode, then the sequence returns to step 177 whereupon the 'Launch' LED on the control panel 109 is illuminated and the machine is maintained in a standby mode.

FIGS. 17-22 depict a second exemplary embodiment of a football passing machine 200 (hereinafter machine 200) and components thereof. The machine 200 is similar to machine 100 of FIGS. 1-16B and the previously described details of the machine 100 also apply to the machine 200. The primary differences between those machines will be described hereinafter.

The football passing machine 200 (referred to hereinafter as machine 200) of FIGS. 17-22 generally includes a frame 202, a vertical ball magazine 204 for containing one or more footballs 201 that is mounted to the frame 202, a guide rail assembly 206 mounted to the frame 202 upon which a football 201 is slid, an escapement arm assembly 208 mounted to the frame 202 for successively releasing footballs onto the guide rail assembly 206, a reciprocating ball carrier assembly 210 mounted to the frame 202 for sliding a football on the guide rail assembly 206 to a launch wheel assembly 212 that is also mounted to the frame 202.

Figure 21A:
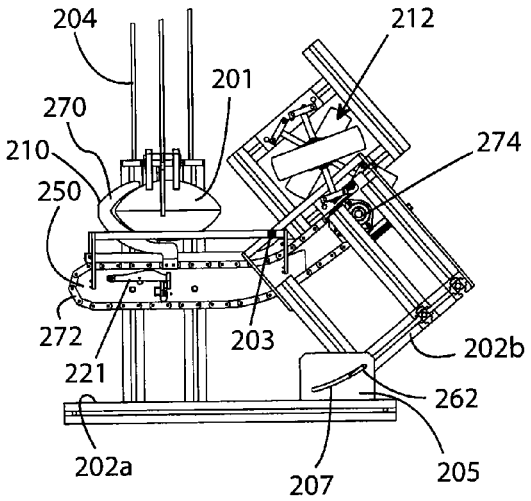

As best shown in FIGS. 17, 20 and 21A, the frame 202 of the machine 200 includes a pivotable frame portion 202*b* that is pivotably connected to a stationary frame portion 202*a* by one or more pins 203. As best shown in FIG. 21A, a bracket 205 including a curved slot 207 formed thereon extends from the base of the stationary frame portion 202*a*. A locking pin 262 that is attached to the pivotable frame portion 202*b* is releasably positioned in the curved slot 207 of the bracket 205.

In use, to adjust the position of the pivotable frame portion 202*b* thereby changing the launch angle of the machine 200, a user releases the locking pin 262, manually pivots the moveable frame portion 202*b* to change the launch angle of the football, and re-secures the locking pin 262 to the bracket 205 to lock the position of the frame portion 202*b* relative to the stationary frame portion 202*a*. As stated previously, a motor may be connected to the pivotable frame portion 202*b* to automate this process.

Referring still to FIGS. 17, 20 and 21A, the guide rail assembly 206 of the machine 200 includes a pivotable rail assembly portion 206*b* that is pivotably connected to a stationary rail assembly portion 206*a* by one or more pins 203. The pivotable rail assembly portion 206*b* is connected to the pivotable frame portion 202*b*, whereas, the stationary rail assembly portion 206*a* is connected to the stationary frame portion 202*a*. Each rail assembly portion 206*a* and 206*b* includes two rails that are horizontally spaced apart for supporting a football 201 thereon (see FIGS. 21A-21D and 22D). The rail assembly portions 206*a* and 206*b* form the launch surface of the machine 200.

Referring now to FIGS. 19-21D, the reciprocating ball carrier assembly 210 of the machine includes a ball carrier 270 that is fixedly connected to a chain 272. The chain 272 is driven by an output shaft of a motor 274 around the perimeter surface of a chain guide 250. The chain 272 and the ball carrier 270 slide over the perimeter surface of the chain guide 250. The chain guide 250 is stationary.

The ball carrier 270 of the carrier assembly 210 includes a curved interior surface 273 for engaging the end of a football. As best shown in FIG. 20, the base of the ball carrier 270 is fixedly connected to a link of the chain 272 and does not pivot with respect to that link of the chain when the chain 272 is driven around the chain guide 250.

The motor 274 is connected to the pivotable frame portion 202*b*, whereas the chain guide 250 is connected to the stationary frame portion 202*a*. Thus, pivoting the frame portion 202*b* with respect to the stationary frame portion 202*a* to adjust the launch angle of a football, changes the path of the chain 272. The motor 274 is maintained in a state of tension by a series of springs 276 to accommodate variations in the chain path when the frame portion 202*b* is pivoted with respect to the stationary frame portion 202*a*.

Referring now to FIGS. 20, 21D and 22A-22D, the escapement arm assembly 208 of the machine 200 includes two escapement arms 209*a* and 209*b* that operate together in unison to successively drop footballs 201 onto the stationary rail assembly portion 206*a*. The escapement arms 209*a* and 209*b* are structurally and functionally equivalent. Each escapement arm 209*a* and 209*b* includes four arms 211*a* and 211*b* that are oriented for grasping a football 201. Each escapement arm 209*a* and 209*b* is pivotably connected to the stationary frame portion 202*a* by a pin 213 (see FIG. 22A). Also, each escapement arm 209*a* and 209*b* is biased against rotation by a spring 214 (see FIG. 22B). The escapement arms 209*a* and 209*b* are attached to pivotable rocker arms 217*a* and

217*b* by rods 280*a* and 280*b*, respectively. Although not shown, the rocker arms 217*a* and 217*b* are pivotably connected together by a pin.

As best shown in FIG. 20, the rocker arm 217*b* of the escapement arm assembly 208 includes a protruding portion 219 and the protruding portion 219 is positioned to bear on a pivotable escapement cam follower 221 that pivots about a pin 223. The pivotable escapement cam follower 221 includes a cam follower surface 225 which engages with a surface 227 of a chain cam 229 that is fixedly connected to the chain 272.

As best shown in FIGS. 17 and 19, the launch wheel assembly 212 of the machine 200 includes two motor-driven friction drive wheels 283 that are each positioned in contact with a launch wheel 284. The launch wheel assembly 212 is substantially the same as the launch wheel assembly 112 of the machine 100, however, the launch wheel assembly 212 is mounted to the pivoting frame portion 202*b* of the machine 200.

One exemplary method of operating the machine 200 will now be described with reference to FIGS. 21A-21D and 22A-22D. FIGS. 21A-21D depict the ball carriage assembly 210 sliding a football from a first point beneath the ball magazine 204 to a second point adjacent the launch wheel assembly 212 of the machine 200, and FIGS. 22A-22D depict the process of the escapement arm assembly 208 releasing a football onto the ball guidance rail assembly 206 of the machine 200. It should be understood that the following description of the exemplary method may vary from that which will be described and is not limited to any particular sequence or steps.

According to the method, the operator first loads one or more standard-sized footballs 201 into the vertical ball magazine 204. As the footballs 201 are loaded into the magazine 204, the footballs 201 land on top of one another in the appropriate orientation due to the geometry of the vertical ball magazine 204. The lower-most football 201*a* in the magazine comes to rest in the appropriate orientation against the arms 211*b* (see FIG. 22A) of the escapement arms 209*a* and 209*b* of the escapement arm assembly 208. The escapement arm assembly 208 is initially maintained in the home position shown in FIGS. 22A and 22D.

To adjust the trajectory of the football, the operator may loosen the locking pin 262 to pivot the pivotable frame portion 202*b* to any desired location. Once the fastener 262 is re-tightened, the machine 200 is ready to be activated by an operator via a user interface (not shown) of the machine 200. The operator then activates the motor 274 of the machine 200, which drives the chain 272 around the chain guide 250. At this point of the process, it can be assumed that a football 201 is not yet positioned on the stationary rail assembly portion 206*a*.

Referring now FIGS. 21D-22D, the surface 227 of the chain cam 229 ultimately comes into contact with the cam follower surface 225 of the pivotable escapement cam follower 221. The chain cam 229 pushes down the escapement cam follower 221, which pushes down the protruding portion 219 of the rocker arm 217*b*, which causes both rocker arms 217*a* and 217*b* to move downwardly, which pushes down the rods 280*a* and 280*b*, which pivots the escapement arms 209*a* and 209*b* against their springs 214, respectively.

Figures 22A, 22B, 22C, 22D:
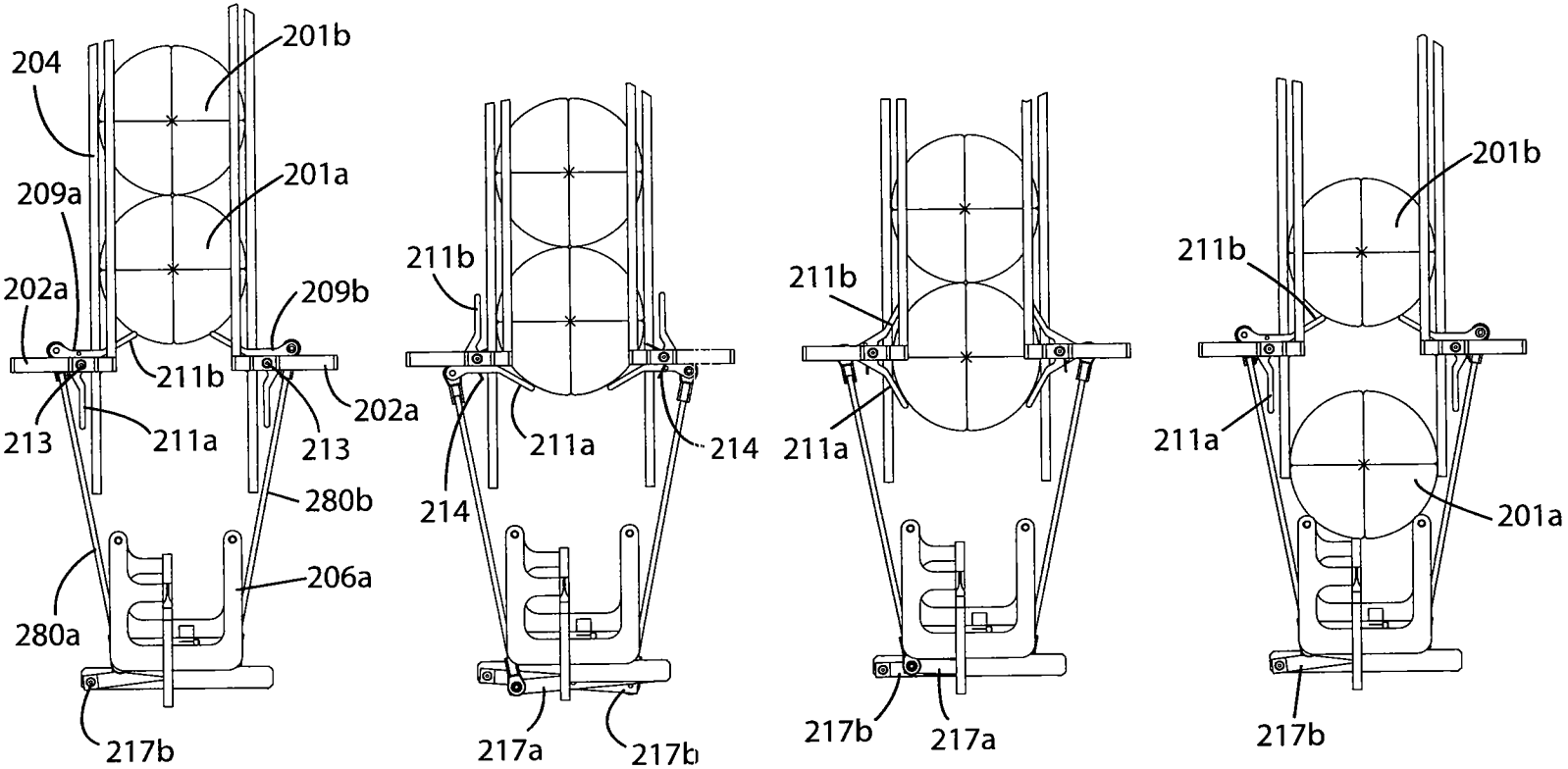

The pivoting action of the escapement arms 209*a* and 209*b* causes the escapement arms 209*a* and 209*b* to engage the lowermost football 201*a* (see FIG. 22B), move the football 201*a* downward (see FIG. 22C), and drop the football 201*a* onto the rail assembly portion 206*a* (see FIG. 22D) while preventing the next football 201*b* in the vertical ball magazine 204 from dropping onto the rail assembly portion 206*a* (note the orientation of arm 211*b* in FIG. 22D). The springs 214 connected to each escapement arm 209*a* and 209*b* bring the escapement arm 209*a* and 209*b* back to their home position shown in FIG. 22D. The football 201*a* that is positioned on the rail assembly portion 206*a* is then ready to be contacted by the ball carrier 270.

Figure 21B:
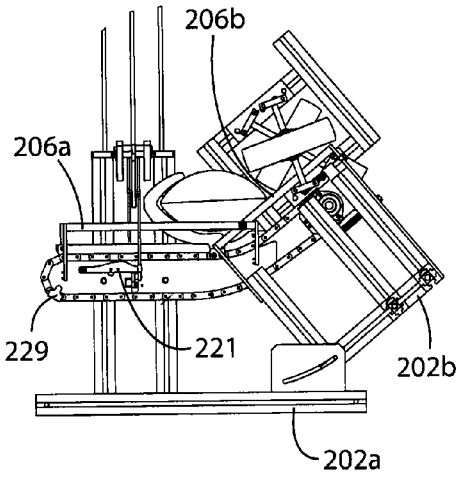

In FIG. 21A, the ball carrier 270 comes into contact with the football 201*a* that is positioned on the rail assembly portion 206*a* when the ball carrier 270 is rotated to a position beneath the ball magazine 204. The curved interior surface 273 of the ball carrier 270 engages the end of the football 201*a*. As shown in FIG. 21B, as the motor 274 rotates the chain 272 around the chain guide 250, the ball carrier 270 slides the football 201*a* along the stationary rail assembly portion 206*a*.

Figure 21C:
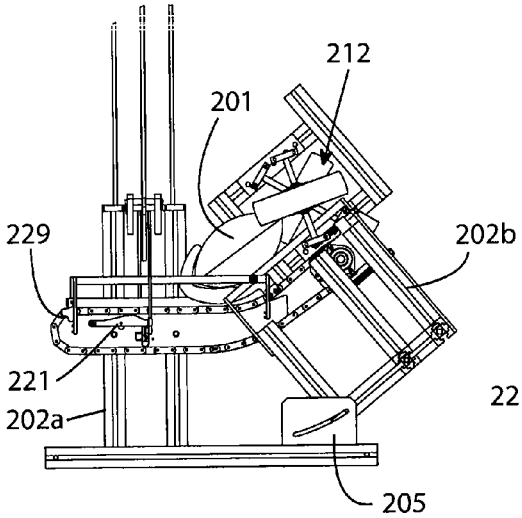
Figure 21D:
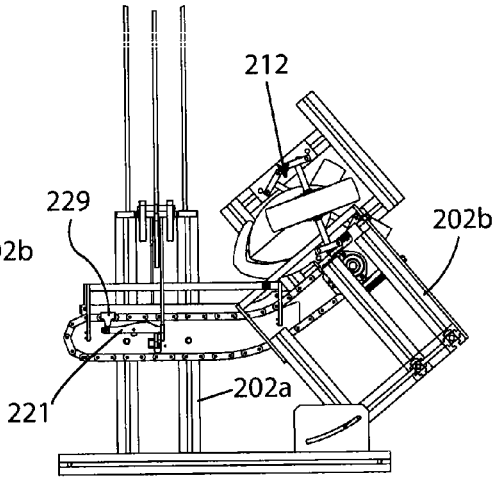

As shown in FIG. 21C, once the carrier 270 moves the football 201*a* onto the pivotable rail assembly portion 206*b* (shown pivoted) the carrier 270 pivots counterclockwise to adjust to the steep path of the chain 272. As shown in FIG. 21D, as the motor 274 rotates further, the ball carrier 270 moves the football 201*a* along the pivotable rail assembly portion 206*b* until the football 201*a* reaches the launch wheel assembly 212. Once the football 201*a* makes contact with the launch wheel assembly 212, the launch wheels launch the football 201*a* into the air. The above-described process is then repeated to launch the next football 201*b* in the vertical ball magazine 204.

While two exemplary embodiments of the Invention have been shown and described herein, it will be understood that such embodiments are provided by way of example only. Numerous variations, changes and substitutions will occur to those skilled in the art without departing from the spirit of the Invention. For example, while the football passing machine embodiments disclosed herein are tailored for passing prolate-spheroid-shaped footballs, those skilled in the art will recognize that those embodiments can be modified to pass balls of different shapes and sizes, such as baseballs, tennis balls, rugby balls, soccer balls, and so forth. Additionally, the football passing machine embodiments disclosed herein may be toys or professional grade. It is intended that the appended claims cover all such variations as fall within the spirit and scope of the Invention.

What is claimed is:

1. A football passing machine that is configured to eject a prolate-spheroid-shaped football comprising:

a frame member;

an adjustable launch surface slidably mounted to the frame member, said adjustable launch surface comprising opposing and spaced apart rail surfaces defining a curved pathway along which the football travels, and wherein said opposing and spaced apart rail surfaces are defined on respective rails, and the rails are slidable along the curved pathway for adjusting a launch angle of the football that is to be launched from the adjustable surface;

a football launch mechanism that is configured to eject a football from the football passing machine and is fixed to an end of the launch surface such that the football launch mechanism moves along with the adjustable launch surface upon sliding the adjustable launch surface with respect to the frame member, wherein a rotation angle of the adjustable launch surface is configured to be adjusted in order to change a launch angle of a football while the frame member remains stationary.

2. The football passing machine of claim 1 further comprising a vertically-oriented ball magazine that is configured to contain a plurality of footballs and is positioned above the adjustable launch surface, and an escapement arm assembly including a moveable escapement arm that is configured to successively dispense footballs that are contained within the vertically-oriented ball magazine onto the launch surface.

3. The football passing machine of claim 2, wherein the escapement arm includes a first surface for cradling a first football that is to be positioned on the launch surface, and a second surface that is configured to prevent a second football, which is positioned above the first football in the vertically-oriented ball magazine, from moving toward the launch surface.

4. The football passing machine of claim 1, further comprising a ball carriage assembly that is configured to move a football along the launch surface in a direction toward the football launch mechanism.

5. The football passing machine of claim 4, wherein the ball carriage assembly includes a conical surface for accommodating a football.

6. The football passing machine of claim 4 further comprising a means for sensing the position of the ball carriage assembly relative to the launch surface.

7. The football passing machine of claim 4, wherein the ball carriage assembly is positioned adjacent the launch surface.

8. The football passing machine of claim 1 further comprising a ball carriage assembly that is configured to move a football along the launch surface in a direction toward the football launch mechanism, wherein at least one of the rails includes a curved recess in which the ball carriage assembly travels.

9. The football passing machine of claim 1 further comprising a ball carriage assembly that is configured to move a football along the launch surface in a direction toward the football launch mechanism, wherein the ball carriage assembly travels along the curved pathway.

10. The football passing machine of claim 1, wherein a radius of curvature of the rail surfaces is substantially constant.

11. A football passing machine that is configured to eject a prolate-spheroid-shaped football comprising:

a frame member;

a guide rail assembly slidably mounted to the frame member, said guide rail assembly including opposing and spaced apart guide rail surfaces defining a curved pathway upon which the football travels, wherein said opposing and spaced apart rail surfaces are defined on respective rails, and the rails are slidable along the curved pathway for adjusting the launch angle of the football that is to be launched from the guide rail assembly; and a moveable ball carriage that is movable on the guide rail assembly and is configured to travel in a reciprocating motion along the curved pathway of the guide rail surfaces to move a football between a first point on the launch surface and a second point on the launch surface that is adjacent a football launch mechanism that is configured to eject a football from the football passing machine, wherein the moveable ball carriage includes a surface that is configured to accommodate an end of a prolate-spheroid-shaped football, and a means for moving the carriage along the launch surface between the first point and the second point.

12. The football passing machine of claim 11, wherein the means for moving comprises a motor that is configured to move the carriage along the launch surface.

13. The football passing machine of claim 12, wherein the means for moving further comprises a chain that is driven along a path by the motor, and the moveable ball carriage is connected to the chain.

14. The football passing machine of claim 13, wherein the launch surface and a path of the chain are configured to be adjusted in order to change a launch angle of the football, and the machine further comprises a spring that is attached to either the motor or the chain to accommodate adjustments to the path of the chain.

15. The football passing machine of claim 11 further comprising a means for sensing the position of the moveable carriage relative to the launch surface.

16. The football passing machine of claim 11, wherein the moveable carriage is positioned adjacent the launch surface.

17. The football passing machine of claim 11 further comprising a ball magazine positioned above the launch surface that is configured to contain a plurality of footballs, and said first point on the launch surface is located directly beneath the ball magazine.

18. The football passing machine of claim 17, further comprising an escapement arm assembly including a moveable escapement arm that is configured to successively dispense footballs that are contained within the vertically-oriented ball magazine onto the launch surface.

19. The football passing machine of claim 18, further comprising a means for sensing the position of the escapement arm.

20. The football passing machine of claim 11, wherein the surface that is configured to accommodate an end of a prolate-spheroid-shaped football is substantially conical.

21. A football passing machine that is configured to eject a prolate-spheroid-shaped football comprising:

a frame member;

an adjustable guide rail assembly being adjustably mounted to the frame member, wherein the adjustable guide rail assembly includes opposing and spaced apart rail surfaces upon which the football travels, each rail surface defining a curved pathway upon which a football is configured to travel, and wherein said opposing and spaced apart rail surfaces are defined on respective rails, and the rails are slidable along the curved pathway for adjusting a launch angle of the football that is to be launched from the guide rail assembly; and football launch wheels configured to eject a football from the football passing machine and fixed to an end of the adjustable guide rail assembly such that the football launch wheels move along with the adjustable guide rail assembly upon sliding the adjustable guide rail assembly with respect to the frame member.

22. The football passing machine of claim 21 further comprising a ball dispenser that is configured to dispense a football onto the launch surface.

23. The football passing machine of claim 21 further comprising a moveable ball carriage that is mounted directly to each rail surface and is configured to travel in a reciprocating motion along the curved pathway of the guide rail assembly to move a football between a first point on the guide rail assembly and a second point on the guide rail assembly that is adjacent the football launch mechanism.

* * * * *